US009370954B2

(12) United States Patent
Sasayama

(10) Patent No.: US 9,370,954 B2
(45) Date of Patent: Jun. 21, 2016

(54) METHOD FOR MEASURING AMOUNT OF POSITIONAL DEVIATION AND IMAGE-RECORDING DEVICE

(71) Applicant: FUJIFILM Corporation, Tokyo (JP)

(72) Inventor: Hiroyuki Sasayama, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 14/824,944

(22) Filed: Aug. 12, 2015

(65) Prior Publication Data

US 2015/0343820 A1 Dec. 3, 2015

Related U.S. Application Data

(63) Continuation of application No. PCT/JP2014/054370, filed on Feb. 24, 2014.

(30) Foreign Application Priority Data

Mar. 15, 2013 (JP) ..... 2013-053226

(51) Int. Cl.
*B41J 2/21* (2006.01)
*B41J 29/393* (2006.01)

(52) U.S. Cl.
CPC ..... *B41J 29/393* (2013.01); *B41J 2/2135* (2013.01); *B41J 2/2146* (2013.01); *B41J 2/2142* (2013.01); *B41J 2029/3935* (2013.01)

(58) Field of Classification Search
CPC ..... B41J 2/2146
USPC ..... 347/13
See application file for complete search history.

(56) References Cited

U.S. PATENT DOCUMENTS

2004/0224102 A1* 11/2004 Ebihara ..... B41J 29/393 428/32.1
2005/0062784 A1 3/2005 Matsuzaki et al.
2008/0309710 A1* 12/2008 Murayama ..... B41J 11/007 347/40
2011/0279505 A1* 11/2011 Shin ..... B41J 29/393 347/14

FOREIGN PATENT DOCUMENTS

JP H11-180013 A 7/1999
JP 2005-053167 A 3/2005
JP 2006-305894 A 11/2006

OTHER PUBLICATIONS

International Search Report for PCT/JP2014/054370 dated May 20, 2014.

* cited by examiner

*Primary Examiner* — Shelby Fidler
(74) *Attorney, Agent, or Firm* — Studebaker & Brackett PC

(57) ABSTRACT

Dot patterns are recorded on a recording medium at intervals determined in advance in a second direction using first and second head modules while relatively moving a recording head and the recording medium in the second direction. The dot patterns are optically read, and a density profile representing change in density in the second direction of a read image of the dot patterns is calculated. A repetition period of a waveform corresponding to each dot pattern in the density profile is calculated, and data of the density profile is integrated and averaged in each repetition period to calculate an integrated density profile. A peak position of a waveform corresponding to each dot pattern in the integrated density profile is obtained, and the amount of positional deviation is calculated based on each peak position.

18 Claims, 29 Drawing Sheets

METHOD FOR MEASURING AMOUNT OF POSITIONAL DEVIATION AND IMAGE-RECORDING DEVICE

CROSS-REFERENCE TO RELATED APPLICATIONS

This application is a Continuation of PCT International Application No. PCT/JP2014/54370, filed on Feb. 24, 2014, which claims priority under 35 U.S.C. §119(a) to Japanese Patent Application No. 2013-053226, filed on Mar. 15, 2013. Each of the above application(s) is hereby expressly incorporated by reference, in its entirety, into the present application.

BACKGROUND OF THE INVENTION

1. Field of the Invention

The present invention relates to a method for measuring the amount of positional deviation which measures the amount of positional deviation between recording positions of a plurality of head modules of a recording head, and an image-recording device which measures the amount of positional deviation using the method.

2. Description of the Related Art

As a recording system of an ink jet printer (image-recording device), a line system which records an image with a single drawing pass by a line head along with transport of a recording medium is known. In the line system, a long line head (recording head) is used along a width direction (main scanning direction) of the recording medium orthogonal to a transport direction (sub scanning direction) of the recording medium. It is not realistic to integrally form the line head of silicon wafer, glass, or the like due to problems of yield, heat, cost, and the like. For this reason, in the line system, a line head in which head modules each having nozzles arranged in a two-dimensional manner are arranged in parallel in the width direction of the recording medium is usually used.

When performing image recording using the line head, if the position of the individual head module is deviated in the sub scanning direction, the recording position of the individual head module undergoes a positional deviation in the sub scanning direction; thus, there is a problem in that quality of a recorded image is degraded. For this reason, various methods which detect the amount of positional deviation in the sub scanning direction of the recording position of each head module are suggested.

In a method for measuring the amount of positional deviation described in JP 4770256B, first, line patterns extended long in the width direction of the recording medium are recorded at intervals of n pixels in the sub scanning direction centering on a reference line by one of adjacent head module to form a first line group. Simultaneously, line patterns are recorded at intervals of n+1 pixels in the sub scanning direction centering on the reference line by the other head module to form a second line group. Next, the first line group is compared to the second line group to identify a first line pattern of the first line group and a second line pattern of the second line group aligned in the transport direction. The amount of positional deviation is calculated as $[k\times((n+1)-n)]$ pixels based on the amount of positional deviation (a k-th position from the reference pattern) from the first and second line patterns. With this, it is possible to measure the amount of positional deviation in the sub scanning direction between the recording positions of adjacent head modules in terms of pixels.

SUMMARY OF THE INVENTION

If the method for measuring the amount of positional deviation of JP 4770256B is used, it is possible to measure the amount of positional deviation of the recording position between the head modules in terms of pixels; thus, it is possible to perform the correction of the amount of positional deviation in terms of pixels. However, the inventors have found experimentally that, if the amount of positional deviation of the recording position between the head modules does not fall within about ±5μ, image quality of a recorded image is degraded. For this reason, for example, when recording resolution is 1200 dpi, it is necessary to measure the amount of positional deviation of the recording position between the head modules with accuracy of about 1/4 pixels.

When measuring the amount of positional deviation, a read image obtained by reading a test chart or the like recorded by each head module with an image sensor of an image scanner is analyzed; however, in order to measure the amount of positional deviation on the order of about 1/4 pixels, a high-resolution image sensor is required. As a result, manufacturing cost of a device which measures the amount of positional deviation is increased.

An aspect of the invention is to provide a method for measuring the amount of positional deviation capable of measuring the amount of positional deviation of a recording positions between head modules with high accuracy, and an image-recording device which measures the amount of positional deviation using the method.

A method for measuring the amount of positional deviation for attaining the object of the invention includes a recording step of, while relatively moving a recording head with a plurality of head modules each having a plurality of recording elements arranged in a first direction and a recording medium in a second direction orthogonal to the first direction, recording dot patterns having a shape extended in the first direction on the recording medium at intervals determined in advance in the second direction using a first head module and a second head module among the plurality of head modules, a reading step of optically reading the dot patterns recorded on the recording medium in the recording step, a density profile calculation step of calculating a density profile representing change in density in the second direction of a read image of the dot patterns read in the reading step, a repetition period calculation step of calculating a repetition period of a waveform corresponding to each dot pattern in the density profile based on a calculation result in the density profile calculation step, an integrated density profile calculation step of integrating data of the density profile based on a calculation result of the repetition period calculation step in each repetition period to calculate an integrated density profile, and a positional deviation amount calculation step of obtaining a peak position of a waveform corresponding to each dot pattern in the integrated density profile based on a calculation result of the integrated density profile calculation step and calculating the amount of positional deviation in the second direction between a recording position of the first head module and a recording position of the second head module based on each peak position.

According to the invention, since the amount of positional deviation in the second direction of the recording position between the head modules is calculated based on the read image of the dot patterns recorded on the recording medium at intervals determined in advance in the second direction for each head module, it is possible to measure the amount of positional deviation in the second direction of the recording position between the head modules with high accuracy without using a high-resolution image sensor.

It is preferable that, in the density profile calculation step, a first density profile corresponding to a first dot pattern recorded by the first head module and a second density profile corresponding to a second dot pattern recorded by the second head module are calculated as the density profile, in the repetition period calculation step, a first repetition period of a waveform corresponding to the first dot pattern and a second repetition period representing a repetition period of a waveform corresponding to the second dot pattern are calculated as the repetition period based on the first and second density profiles, in the integrated density profile calculation step, a first integrated density profile obtained by integrating data of the first density profile in each first repetition period and second integrated density profile obtained by integrating data of the second density profile in each second repetition period are calculated as the integrated density profile, and in the positional deviation amount calculation step, a first peak position of a waveform corresponding to the first dot pattern in the first integrated density profile and a second peak position of a waveform corresponding to the second dot pattern in the second integrated density profile are obtained, and the amount of positional deviation is calculated based on the difference between the first peak position and the second peak position. With this, it is possible to measure the amount of positional deviation in the second direction of the recording position between the head modules with high accuracy.

It is preferable that the first head module and the second head module are adjacent to each other in the first direction. With this, it is unlikely to be affected by the tilt (rotation displacement of the recording head with a direction perpendicular to the surface of the recording medium) of the recording head, an error of the transport speed of the recording medium, deformation of the recording medium, an error of reading of the read image of the dot patterns, or the like, it is possible to measure the amount of positional deviation with higher accuracy.

It is preferable that, in an overlap recording area where recording areas on the recording medium of the first and second head modules partially overlap each other, in the recording step, the first dot pattern and the second dot pattern are recorded by the recording elements of the first and second head modules which perform recording in a recording area other than the overlap area. With this, even when the recording areas of the head modules adjacent to each other in the first direction overlap each other, it is possible to measure the amount of positional deviation in the second direction of the recording position between the head modules with high accuracy.

It is preferable that, in an overlap recording area where recording areas on the recording medium of the first and second head modules partially overlap each other, in the recording step, a first dot pattern and a second dot pattern are individually recorded alternately at intervals determined in advance in the second direction as the dot patterns using the recording elements of the first and second head modules which perform recording in the overlap recording area, in the density profile calculation step, a third density profile corresponding to the first dot pattern and the second dot pattern is calculated as the density profile, in the repetition period calculation step, a third repetition period representing a repetition period of a waveform corresponding to the first and second dot patterns in the third density profile is calculated, in the integrated density profile calculation step, a third integrated density profile obtained by integrating data of the third density profile in each third repetition period is calculated as the integrated density profile, and in the positional deviation amount calculation step, a first peak position of a waveform corresponding to the first dot pattern and a second peak position of a waveform corresponding to the second dot pattern in the third integrated density profile are obtained, and the amount of positional deviation is calculated based on the difference between the first peak position and the second peak position. With this, even when the recording areas of the head modules adjacent each other in the first direction overlap each other, it is possible to measure the amount of positional deviation in the second direction of the recording position between the head modules with high accuracy. Furthermore, it is possible to reduce the time necessary for calculating the amount of positional deviation.

The repetition period calculation step has a temporary integrated density profile calculation step of integrating data of the density profile in each temporary repetition period to calculate a temporary integrated density profile, a repetition step of, while changing the temporary repetition period, repeatedly executing the temporary integrated density profile calculation step to calculate the temporary integrated density profile in each temporary repetition period, and a determination step of comparing a maximum value of the temporary integrated density profile in each temporary repetition period and determining the temporary repetition period with the greatest maximum value as the repetition period. With this, it is possible to more accurately calculate the repetition period.

It is preferable that the method further includes a complementary processing step of performing complementary processing on a density profile calculated in the density profile calculation step to enhance the resolution of the density profile in the second direction, and in the repetition period calculation step, a repetition period is calculated based on a density profile subjected to the complementary processing. With this, it is possible to calculate the amount of positional deviation with higher accuracy.

It is preferable that the first direction is a width direction of the recording medium.

It is preferable that the recording head is an ink jet head.

An image-recording device for attaining the object of the invention includes a recording head with a plurality of head modules each having a plurality of recording elements arranged in a first direction, a relative moving unit which relatively moves the recording head and a recording medium in a second direction orthogonal to the first direction, a recording control unit which controls the recording head and the relative moving unit such that dot patterns having a shape extended in the first direction are recorded on the recording medium at intervals determined in advance in the second direction using a first head module and a second head module among the plurality of head modules, a reading unit which optically reads the dot patterns recorded on the recording medium using the first head module and the second head module, a density profile calculation unit which calculates a density profile representing change in density in the second direction of a read image of the dot patterns read by the reading unit, a repetition period calculation unit which calculates a repetition period corresponding to each dot pattern in the density profile based on a calculation result of the density profile calculation unit, an integrated density profile calculation unit which integrates data of the density profile based on a calculation result of the repetition period calculation unit in each repetition period to calculate an integrated density profile, and a positional deviation amount calculation unit which obtains a peak position of a waveform corresponding to each dot pattern in the integrated density profile based on a calculation result of the integrated density profile calculation unit and calculates the amount of positional deviation in the second direction between a recording position of the first head module and a recording position of the second head module based on the peak position.

The method for measuring the amount of positional deviation and the image-recording device of the invention can measure the amount of positional deviation of the recording position between the head modules with high accuracy.

DESCRIPTION OF THE PREFERRED EMBODIMENTS

Ink Jet Printer of First Embodiment

<Configuration of Ink Jet Printer>

Figure 1:
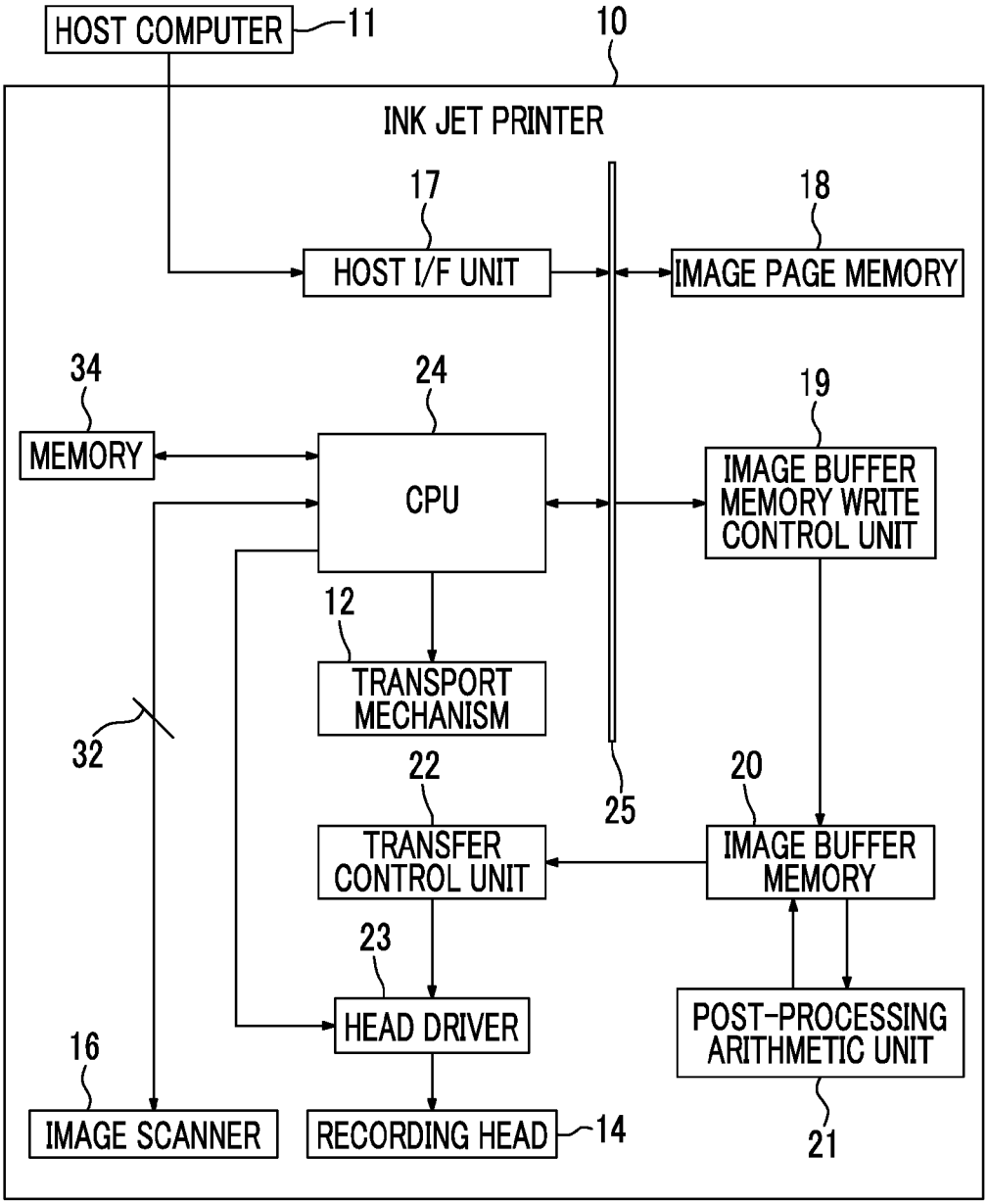
FIG. 1 is a schematic view of an ink jet printer of a first embodiment.

As shown in FIG. 1, an ink jet printer (hereinafter, simply referred to as a printer) 10 corresponding to an image-recording device of the invention is connected to an external host computer 11. The printer 10 deposits ink droplets on a recording sheet (recording medium, see FIG. 2) 13 transported by a transport mechanism (relative moving unit) 12 from a recording head 14 based on image data input from the host computer 11 to record an image on the recording sheet 13. In FIG. 1, only a portion relating to processing of image data is primarily shown.

The printer 10 includes, in addition to the transport mechanism 12 and the recording head 14 described above, an image scanner (reading unit) 16, a host interface (I/F) unit 17, an image page memory 18, an image buffer memory write control unit 19, an image buffer memory 20, a post-processing arithmetic unit 21, a transfer control unit 22, a head driver 23, a CPU 24, and the like. The host I/F unit 17, the image page memory 18, the image buffer memory write control unit 19, and the CPU 24 are connected through a bus 25.

Figure 2:
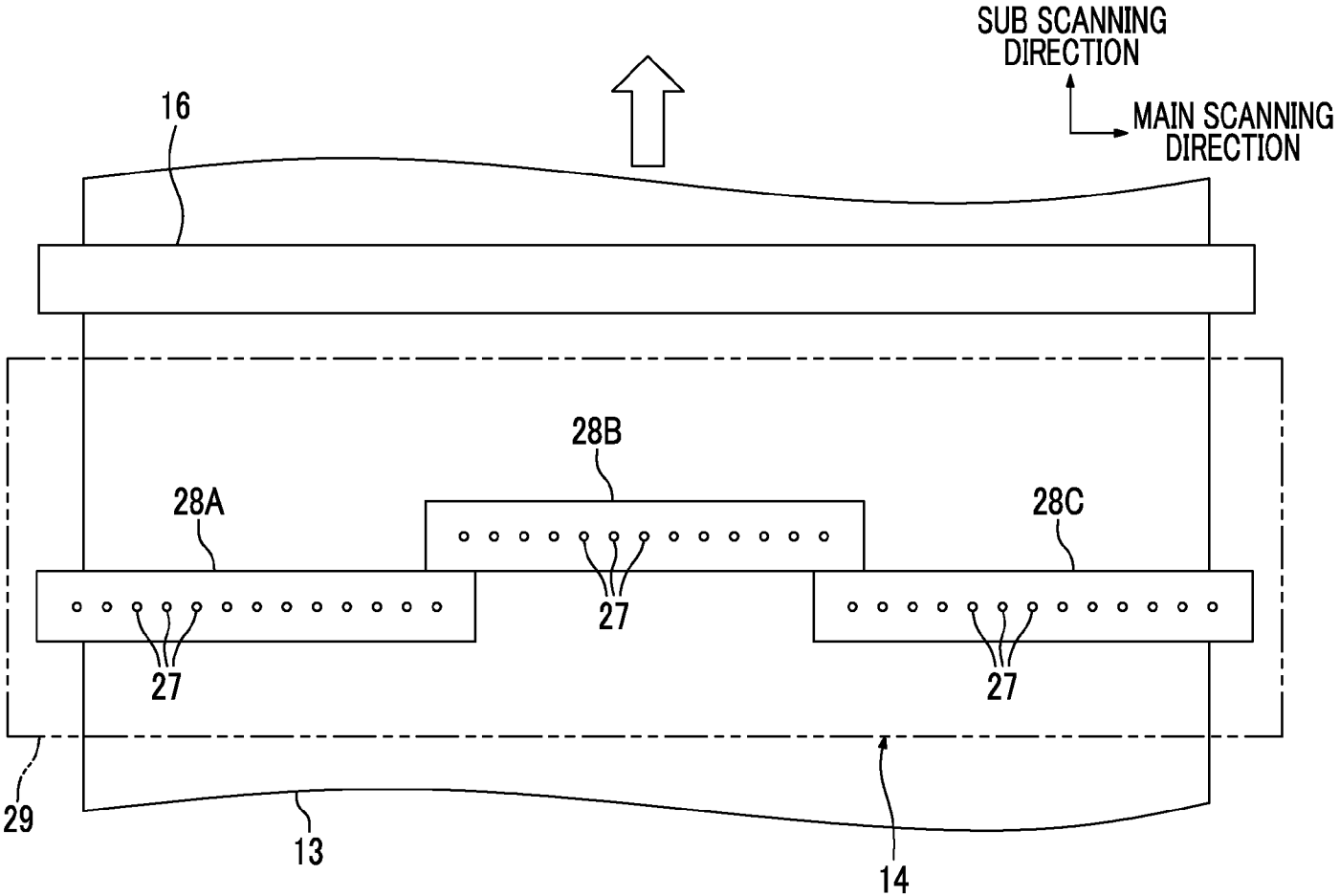
FIG. 2 is a top view of a recording head of the first embodiment.

As shown in FIG. 2, the transport mechanism 12 relatively moves the recording sheet 13 in a sub scanning direction (second direction) perpendicular to the width direction of the recording sheet 13 with respect to the recording head 14 to pass through below the recording head 14. The recording head 14 ejects ink from nozzles 27 arranged on the lower surface (nozzle surface) thereof and forms an image on the recording sheet 13 during relative movement. FIG. 2 is a top view of the recording head 14, and shows the nozzles 27 arranged on the lower surface of the recording head 14 in perspective view. In order to prevent complication of the drawing, the arrangement of the nozzles 27 is simplified.

The recording head 14 is a line head which extends long in a main scanning direction (first direction) parallel to the width direction of the recording sheet 13, and has a length corresponding to the width of the recording sheet 13. The recording head 14 is provided for each color (CMYK) to be recorded.

The recording head 14 includes three replaceable head modules of a first head module 28A, a second head module 28B, and a third head module 28C, and a frame body 29 which retains the head modules 28A to 28C. The head modules 28A to 28C are arranged in zigzag in the main scanning direction. The end portions of two adjacent head modules among the head modules 28A to 28C overlap each other. The recording head 14 may also include tow or, or four or more replaceable head modules of a first head module 73A.

The nozzles 27 of each of the head modules 28A to 28C are arranged so as to be handled equivalent to those linearly arranged at a substantially equal pitch in the main scanning direction. Accordingly, an ink droplet adjacent to an ink droplet deposited using the nozzle 27 at the rightmost end of the first head module 28A in FIG. 2 in the main scanning direction (in this case, the right direction of FIG. 2) can be deposited using the nozzle 27 at the leftmost end of the second head module 28B in FIG. 2. An ink droplet adjacent to an ink droplet deposited using the nozzle 27 at the rightmost end of the second head module 28B in FIG. 2 in the main scanning direction (in this case, the right direction of FIG. 2) can be deposited using the nozzle 27 at the leftmost end of the third head module 28C in FIG. 2.

The image scanner 16 is arranged at a position on the downstream side of the recording sheet transport direction of the recording head 14 to face the recording surface of the recording sheet 13. The image scanner 16 is extended long in the main scanning direction and has a length corresponding to the width of the recording sheet 13. The image scanner 16 optically reads a test chart 31 (see FIG. 5) recorded on the recording surface of the recording sheet 13 by the recording head 14 and outputs test chart read image data 32 (hereinafter, simply referred to as read image data, see FIG. 1) corresponding to a read image of the invention to the CPU 24. As the image scanner 16, an image scanner whose resolution in the sub scanning direction is, for example, about 100 dpi, is used. That is, in this embodiment, reading of the test chart 31 is performed without using a high-resolution image scanner.

Returning to FIG. 1, the host I/F unit 17 is a communication interface which receives image data sent from the host computer 11, and various serial interfaces or parallel interfaces can be used. The host I/F unit 17 sends received image data to the image page memory 18.

The image page memory 18 stores image data input from the host I/F unit 17, and a DRAM or the like which has storage capacity capable of print data for one page is used.

The image buffer memory write control unit 19 reads print data for one line from the image page memory 18 line by line and transfers print data to the image buffer memory 20. Print data for one line is transferred to the image buffer memory 20 and is stored in continuous addresses on the image buffer memory 20. Print data for a plurality of lines is accumulated in the image buffer memory 20.

The post-processing arithmetic unit 21 performs post-processing (correction processing), such as mask processing (deposition inhibition processing) of an abnormal nozzle or shading correction processing (processing for increasing or decreasing a deposition rate for each nozzle), on the image buffer memory 20. Data subjected to the post-processing is rewritten to the image buffer memory 20.

The transfer control unit 22 reads print data for single deposition (for all nozzles of the head modules 28A to 28C) from the image buffer memory 20 and transfers print data to the head driver 23. The transfer control unit 22 performs division processing for dividing print data for single deposition for each of the head modules 28A to 28C and transmitting print data to the head driver 23, or transfer format adjustment.

The head driver 23 is constituted by three drivers (not shown) which individually control driving of head modules 28A to 28C. The head driver 23 controls driving actuators (not shown) corresponding to the nozzles 27 of the head modules 28A to 28C based on print data for head modules 28A to 28C input from the transfer control unit 22, and ejects ink droplets from the nozzles 27. An image is formed on the recording surface of the recording sheet 13 by controlling ink ejection from the head modules 28A to 28C in synchronization with the transport speed of the recording sheet 13.

The CPU 24 successively executes various programs or data read from a memory 34 based on an input signal from an operating unit (not shown) to control the respective units of the printer 10. In a ROM area of the memory 34, in addition to various programs and the like described above, test chart data 35 (see FIG. 4) which is image data of the test chart 31 is stored. A RAM area of the memory 34 is used as a development area of a program executed by the CPU 24 and an arithmetic operation area of the CPU 24.

Figure 13:
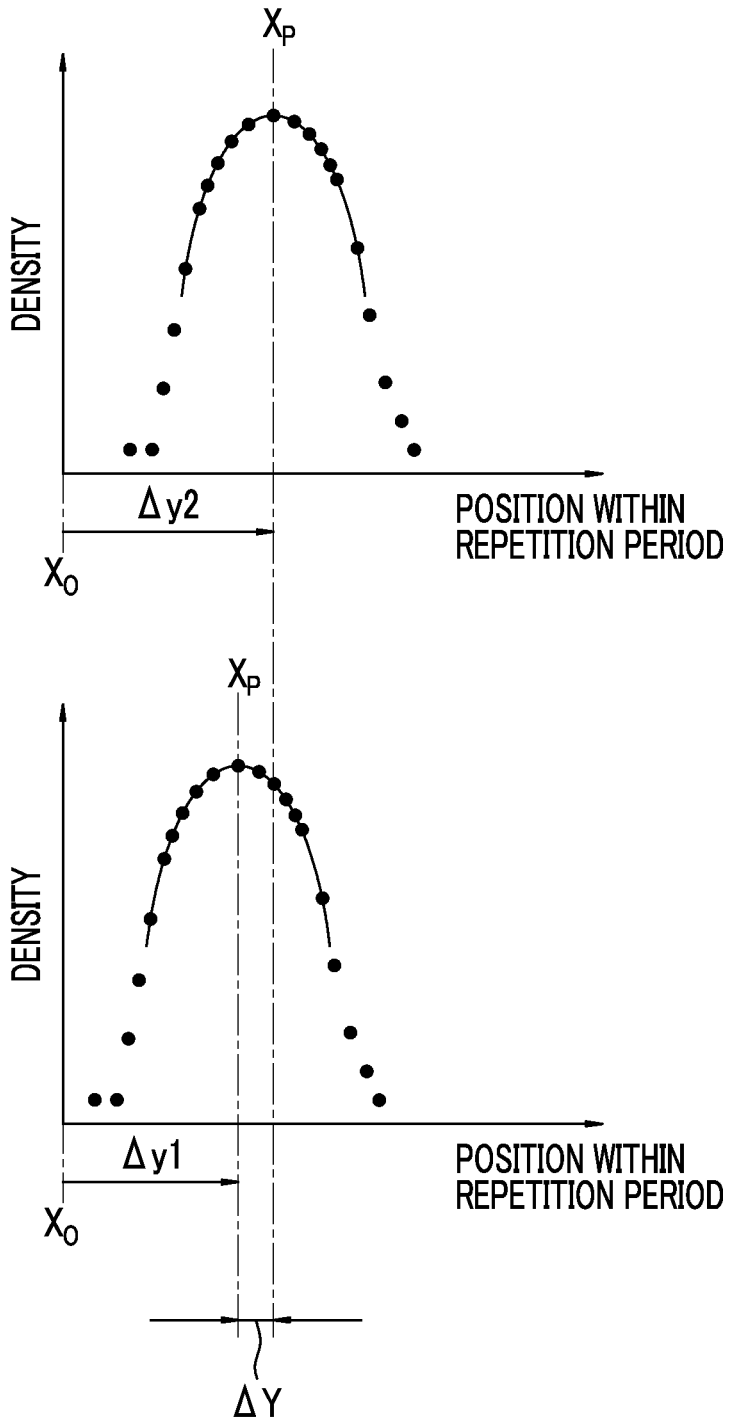
FIG. 13 is an explanatory view illustrating calculation processing of an amount of positional deviation ΔY of the first embodiment.

The CPU 24 calculates the amount of positional deviation ΔY in the sub scanning direction of the recording position between two arbitrary head modules among the head modules 28A to 28C by analyzing read image data 32 input from the image scanner 16 (see FIG. 13). The CPU 24 executes positional deviation correction processing for correcting the recording position between the head modules based on a detection result of the amount of positional deviation ΔY. Hereinafter, "the positional deviation in the sub scanning direction" is simply referred to as "positional deviation".

Figure 3:
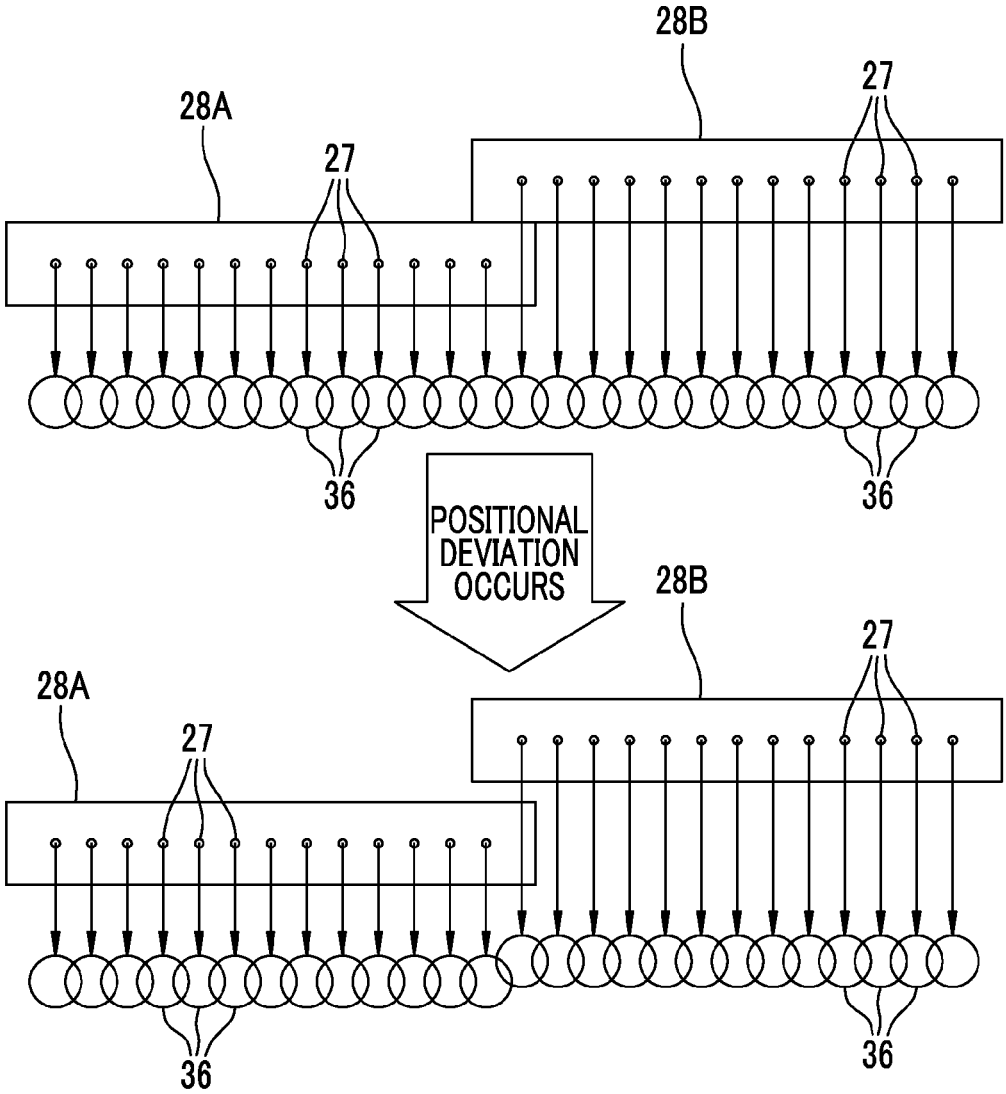
FIG. 3 is an explanatory view illustrating a positional deviation of a recording position of the first embodiment.

As shown in FIG. 3, the positional deviation of the recording position between the head modules occurs due to, for example, the actual positional deviation of the head modules 28A to 28C. Though not shown, the positional deviation of the recording position also occurs due to flight deflection of ink droplets 36 ejected from the nozzles 27 of the head modules 28A to 28C.

<Configuration Relating to Measurement of Amount of Positional Deviation>

Figure 4:
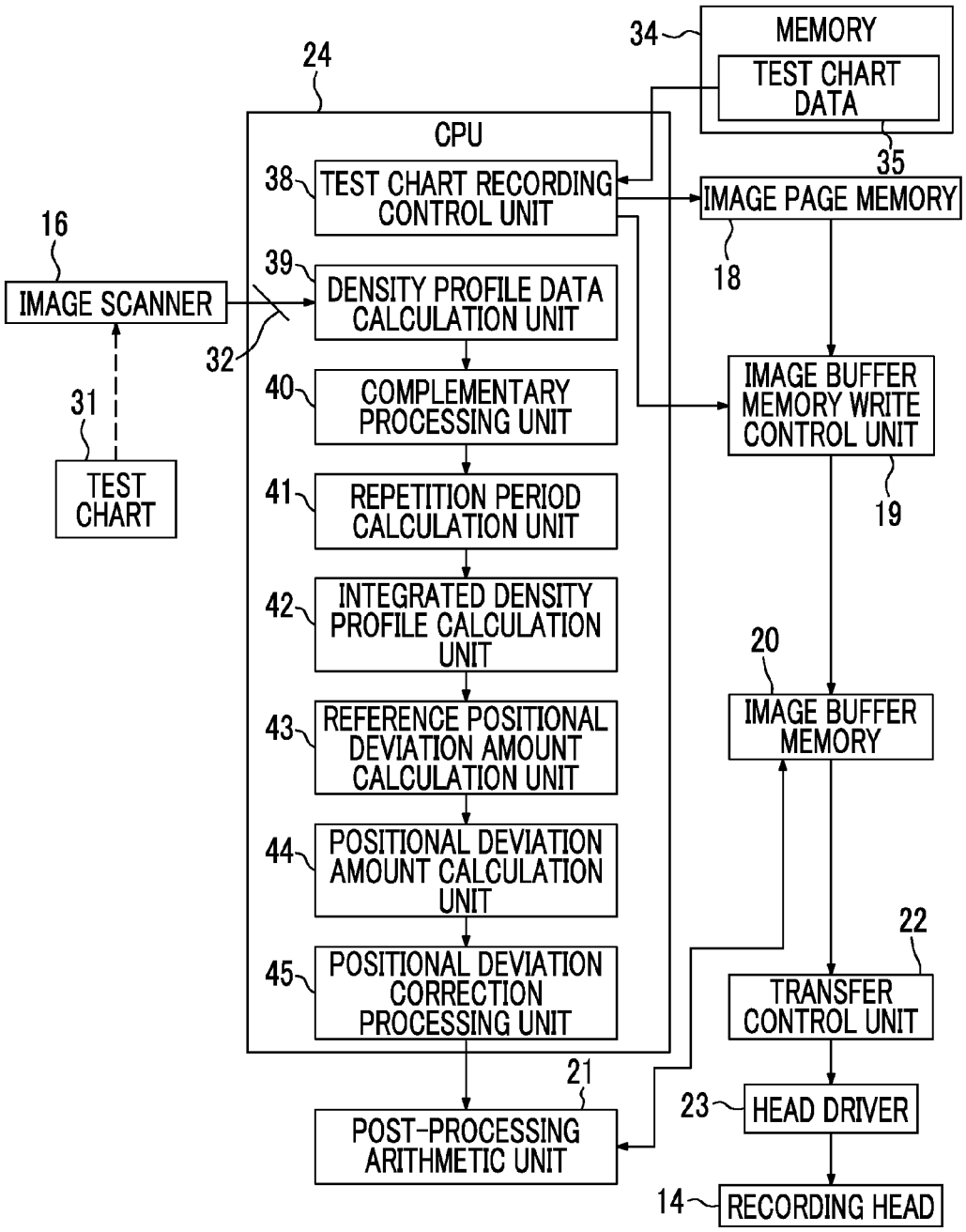
FIG. 4 is a functional block diagram of a CPU of the first embodiment.

As shown in FIG. 4, the CPU 24 reads and executes a program relating to measurement of the amount of positional deviation ΔY or positional deviation correction from the memory 34 to function as a test chart recording control unit (recording control unit) 38, a density profile data calculation unit 39, a complementary processing unit 40, a repetition period calculation unit 41, an integrated density profile calculation unit 42, a reference positional deviation amount calculation unit 43, a positional deviation amount calculation unit 44, and a positional deviation correction processing unit 45.

The test chart recording control unit 38 executes recording of the test chart 31 at a predetermined timing, such as at the time of power-on of the printer 10, at the time of replacement of one of the head modules 28A to 28C, at the time of a measurement operation of the amount of positional deviation ΔY, at the time of recording of a predetermined number of sheets, or at the time of elapse of a predetermined time.

The test chart recording control unit 38 outputs test chart data 35 read from the memory 34 to the image page memory 18 and operates the image buffer memory write control unit 19, the transfer control unit 22, and the head driver 23 at the predetermined timing described above. With this, print data for single deposition based on test chart data 35 is successively transferred to the head driver 23 through the image buffer memory write control unit 19, the image buffer memory 20, the post-processing arithmetic unit 21, and the transfer control unit 22. The head driver 23 controls ink ejection of the nozzles 27 of the head modules 28A to 28C based on print data. The ink droplets 36 are deposited by the head modules 28A to 28C while transporting the recording sheet 13 by the transport mechanism 12, whereby the test chart 31 is recorded on the recording surface of the recording sheet 13. At this time, it is desirable to set the ink ejection timing of each of the head modules 28A to 28C to a value determined in advance and to record the test chart 31 such that the test chart 31 recorded on the recording surface substantially has the same shape as test chart data 35.

Figure 5:
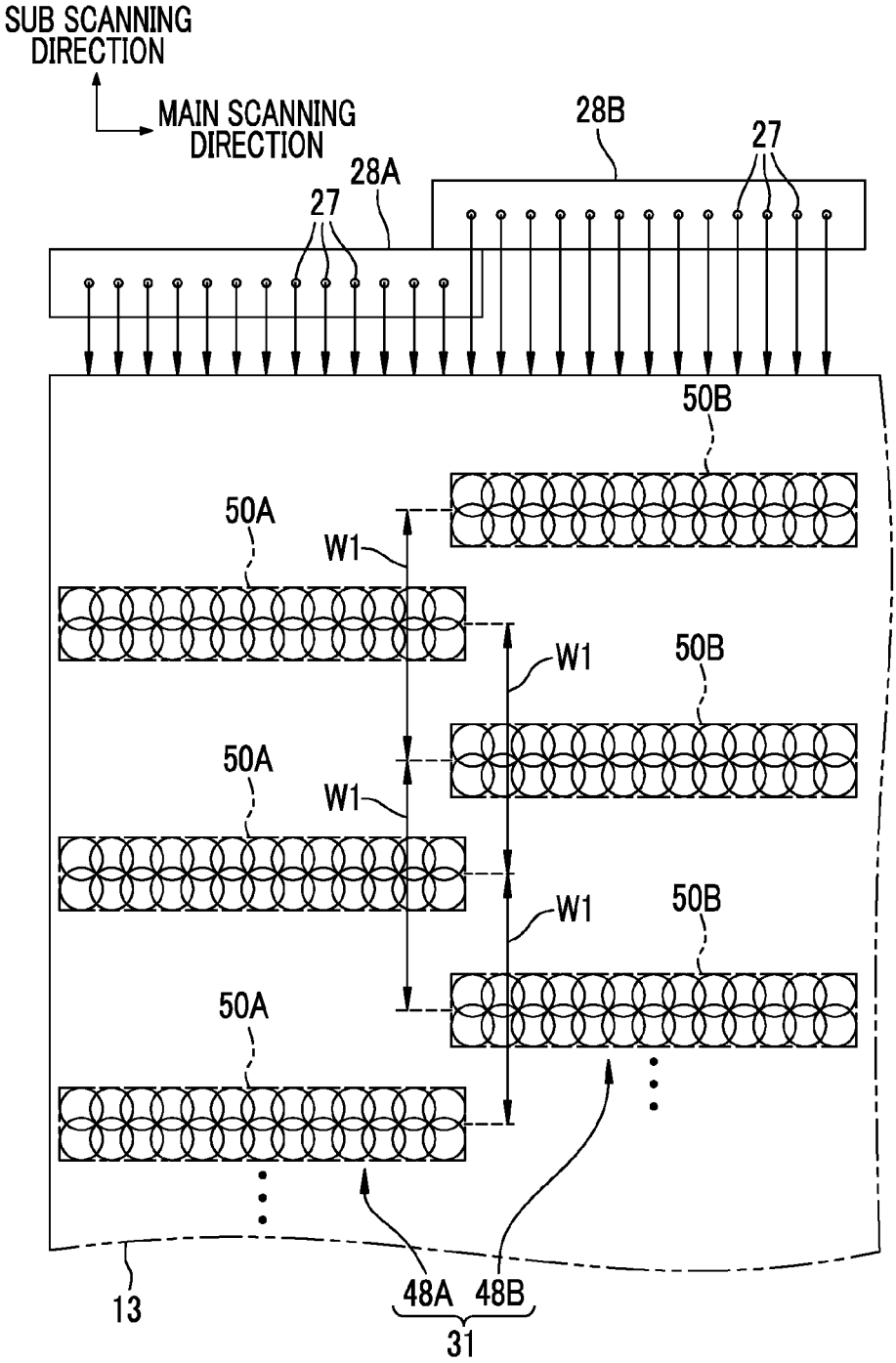
FIG. 5 is a schematic view of a test chart of the first embodiment.

As shown in FIG. 5, the test chart 31 includes a first dot pattern group 48A, a second dot pattern group 48B, and a third dot pattern group (not shown) recorded by the head modules 28A to 28C. The first dot pattern group 48A has, for example, 150 first dot pattern 50A having a shape extended long in the main scanning direction (for example, 5 pixl×64 pixl) at pattern intervals W1 (repetition period) determined in advance in the sub scanning direction. The term "pattern interval W1" used herein is an interval between the positions of the centers of gravity of adjacent dot patterns in the sub scanning direction, the interval between the center positions, or the interval between specific dots.

The second dot pattern group 48B has, for example, 150 second dot patterns 50B having the same shape as the first dot pattern 50A at the pattern intervals W1 (repetition period) in the sub scanning direction. Each second dot pattern 50B is recorded to be deviated from each first dot pattern 50A by an amount according to the positional deviation between the first and second head modules 28A and 28B in the sub scanning direction.

Similarly to the first and second dot pattern groups 48A and 48B, the third dot pattern group has, for example, 150 third dot patterns (not shown) having the same shape as the first dot pattern 50A at the pattern intervals W1 in the sub scanning direction.

The test chart 31 is read by the image scanner 16. With this, read image data 32 is output from the image scanner 16 to the density profile data calculation unit 39.

Returning to FIG. 4, the respective units 39 to 44 from the density profile data calculation unit 39 to the positional deviation amount calculation unit 44 calculate the amount of positional deviation ΔY of the recording position between two adjacent head modules among the head modules 28A to 28C based on read image data 32. Hereinafter, a case of measuring the amount of positional deviation ΔY of the recording position between the first and second head modules 28A and 28B will be described. The first and second head modules 28A and 28B correspond to a first head module and a second head module of the invention, and the first and second dot patterns 50A and 50B correspond to a first dot pattern and a second dot pattern of the invention.

The amount of positional deviation ΔY is calculated by calculating the amount of deviation (hereinafter, referred to as reference amount of positional deviation) of the recording position of each of the first and second head modules 28A and 28B from a reference position determined in advance, and comparing the two reference amounts of positional deviation. The calculation of the reference amounts of positional deviation is executed by the respective units 39 to 43 from the density profile data calculation unit 39 to the reference positional deviation amount calculation unit 43. Hereinafter, the calculation of the reference amount of positional deviation of the recording position of the first head module 28A will be described.

<Calculation of Reference Amount of Positional Deviation of Recording Position of First Head Module>

(Calculation of Density Profile)

Figure 6A:
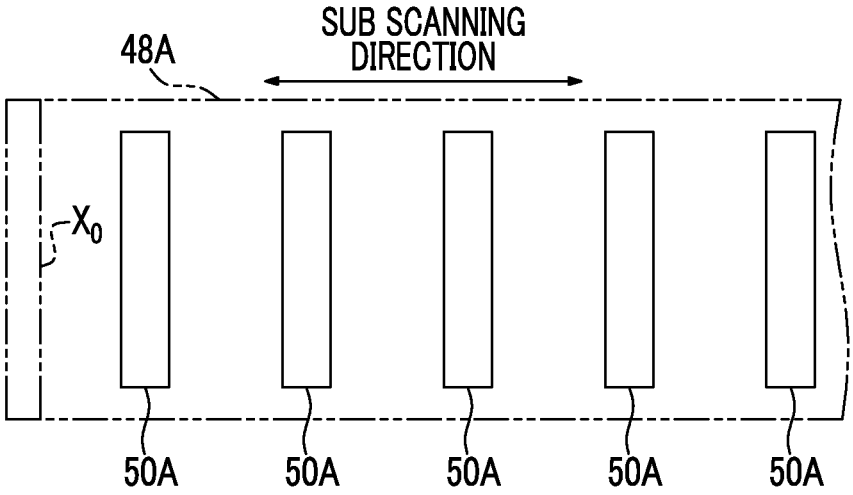
FIGS. 6A and 6B are explanatory views illustrating calculation of a first density profile.
Figure 6B:
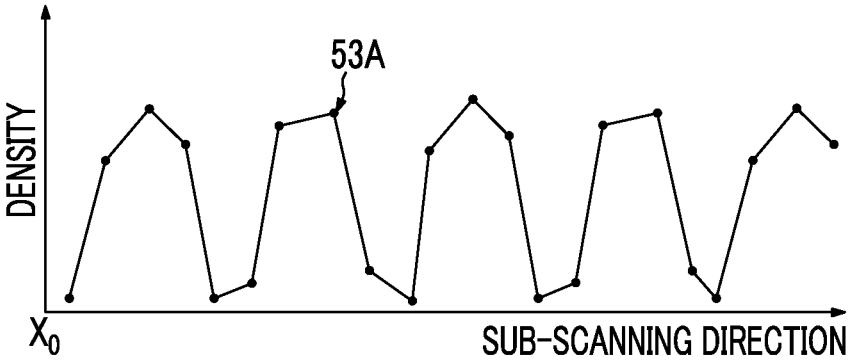

As shown in FIGS. 6A and 6B, the density profile data calculation unit 39 analyzes read image data 32 to calculate a first density profile 53A representing change in density in the sub scanning direction of an image area with the first dot pattern group 48A recorded. The first density profile 53A represents, based on a reference position $X_0$ determined in advance, change in density of the image area in the sub scanning direction from the reference position $X_0$. In the first density profile 53A, the density at a position corresponding to each first dot pattern 50A becomes higher, and conversely, the density at a position corresponding to between the first dot patterns 50A becomes lower.

The reference position $X_0$ is, for example, a position separated from the first dot pattern 50A positioned in one end portion of the first dot pattern group 48A in the sub scanning direction by a maximum of (W1)/2 in a direction parallel to the sub scanning direction and away from the first dot pattern group 48A. The reference position $X_0$ may be appropriately changed, and may be, for example, between the first dot patterns 50A.

In this embodiment, since the resolution (for example, 100 dpi) of the image scanner 16 in the sub scanning direction is lower than the resolution (for example, 600 dpi) of the test chart 31 in the sub scanning direction, the resolution of the first density profile 53A in the sub scanning direction becomes low. That is, the interval of the respective measurement points in the sub scanning direction of the first density profile 53A is increased. The density profile data calculation unit 39 outputs the first density profile 53A to the complementary processing unit 40.

(Complementary Processing: Resolution Enhancement)

Figure 6C:
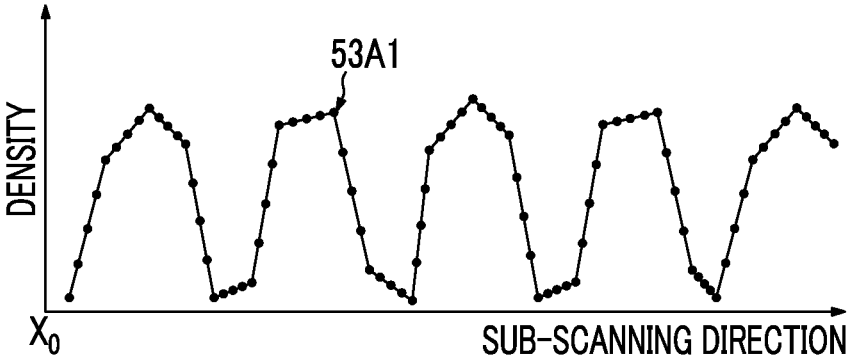
FIG. 6C is an explanatory view illustrating complementary processing.

As shown in FIG. 6C, the complementary processing unit 40 performs complementary processing (linear complementary processing) for complementing (also called interpolation) linear complementary data between the measurement values at the respective measurement points of the first density profile 53A to enhance the resolution of the first density profile 53A in the sub scanning direction from 100 dpi to 10000 dpi. For example, when the resolution of the image sensor of the image scanner 16 is "$R_m$", the resolution after resolution enhancement is "$R_h$", the measurement value (density value) at an arbitrary measurement point i is "$D_i$", and the measurement value at an adjacent measurement point i+1 is "$D_{i+1}$", linear complementary data "$D_{i(j)}$" is expressed by Expression (1) described below. However, j is an integer of 1 to $((R_h \div R_m)-1)$. The complementary processing unit 40 outputs a resolution-enhanced first density profile 53A1 to the repetition period calculation unit 41.

$$D_{i(j)}=(((R_h \div R_m)-1)\times D_i+j\times D_{i+1})\div(R_h \div R_m) \quad (1)$$

(Calculation of Repetition Period Length)

Figure 7A:
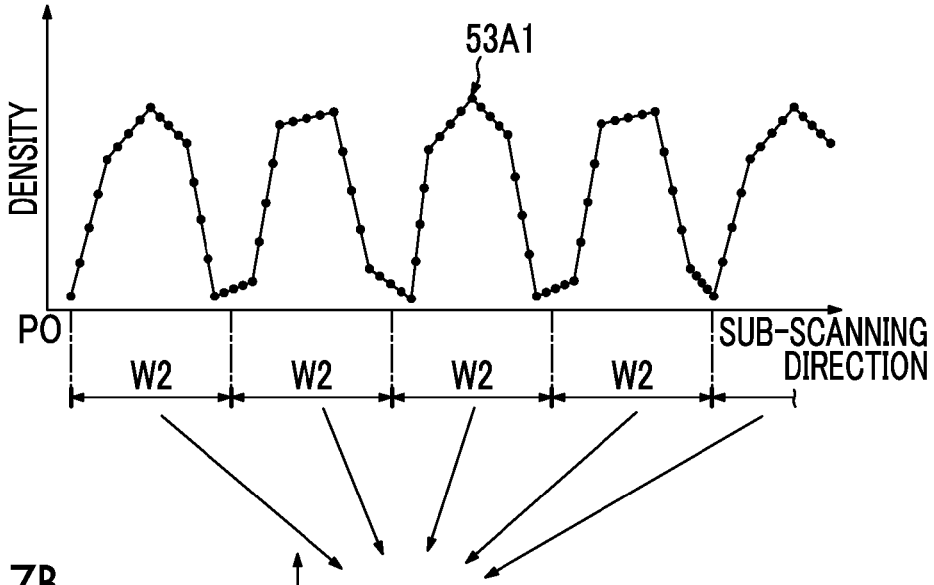
FIG. 7A is an explanatory view illustrating calculation of a repetition period length.

As shown in FIG. 7A, the repetition period calculation unit 41 calculates a repetition period length W2 representing a repetition period (that is, a period in which the peak of the density value appears) of change in density corresponding to the first dot pattern 50A based on the first density profile 53A1. The repetition period length W2 does not completely match the pattern interval W1 described above, and an error of about several % occurs between the repetition period length W2 and the pattern interval W1 due to a resolution fluctuation factor, such as an error of the transport speed of the recording sheet 13, deformation of the recording sheet 13, an error of reading of the image scanner 16, or the like. If the repetition period length W2 is not accurately obtained, the peak value corresponding to each first dot pattern 50A is averaged at the time of integration average by the integrated density profile calculation unit 42 described below; thus, accurate integration cannot be performed and the accurate position (see FIG. 11) of the peak cannot be obtained. Accordingly, the repetition period calculation unit 41 calculates the repetition period length W2 accurately by the following method.

Figure 8:
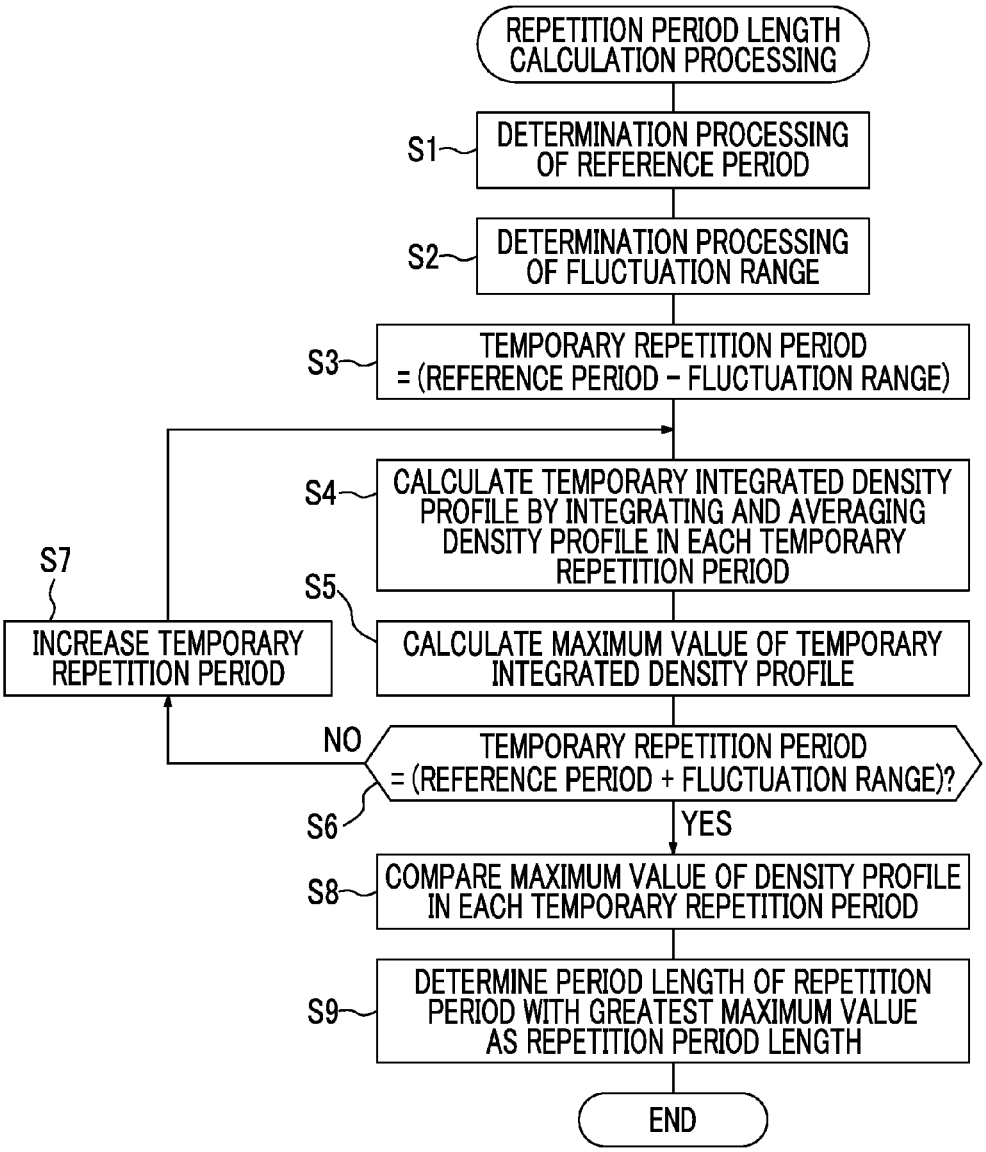
FIG. 8 is a flowchart showing the flow of calculation processing of a repetition period length.

As shown in FIG. 8, initially, the repetition period calculation unit 41 determines an approximate period (for example, a repetition period when the above-described resolution fluctuation factor, such as the above-described pattern interval W1, is neglected) of a repetition period as a reference period (resolution-enhanced value) of a temporary repetition period (Step S1). Next, the repetition period calculation unit 41 determines a value of several % to 10% of the reference period as a fluctuation range of the temporary repetition period (Step S2). That is, the temporary repetition period is changed in a stepwise manner between (reference period−fluctuation range) to (reference period+fluctuation range).

Figure 7B:
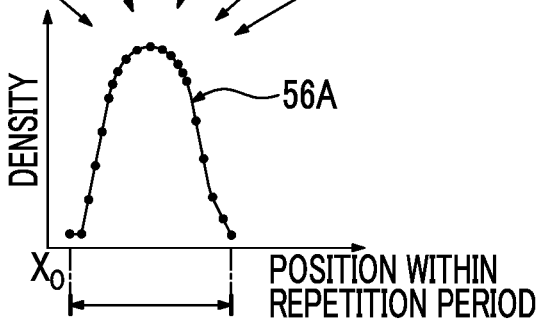
FIG. 7B is an explanatory view illustrating calculation of a first integrated density profile.

The repetition period calculation unit 41 sets an initial temporary repetition period to "reference period−fluctuation range" (Step S3). After the setting, the repetition period calculation unit 41 integrates and averages the density value of the first density profile 53A1 in each temporary repetition period to calculate a temporary integrated density profile (Step S4, temporary integrated density profile calculation step). The temporary integrated density profile is basically the same as a first integrated density profile 56A described below (FIG. 7B). The repetition period calculation unit 41 obtains the maximum value (maximum amplitude, intensity) of the temporary integrated density profile (Step S5).

Next, the repetition period calculation unit 41 determines a period obtained by increasing the initial temporary repetition period by several % of the above-described fluctuation range as a new temporary repetition period (NO in Step S6, Step S7). The repetition period calculation unit 41 repeatedly executes the calculation of the temporary integrated density profile and the calculation of the maximum value of the temporary integrated density profile based on the new temporary repetition period (Steps S4 and S5). Hereinafter, similarly, the repetition period calculation unit 41 repeatedly executes the processing of Steps S7, S4, and S5 until the maximum value of the temporary integrated density profile corresponding to a final temporary repetition period (reference period+fluctuation range) is calculated (No in Step S6, repetition step).

Figure 9:
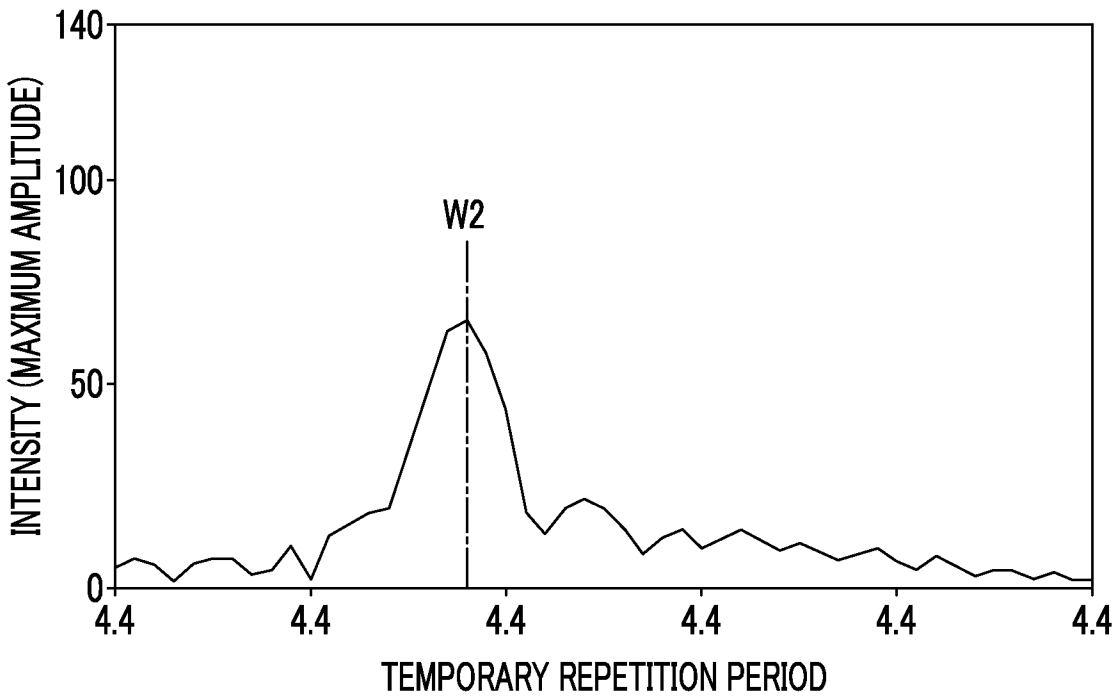
FIG. 9 is an explanatory view illustrating processing of Step S9 in FIG. 8.

As shown in FIG. 9, the repetition period calculation unit 41 calculates the maximum values of the temporary integrated density profiles corresponding to all temporary repetition periods (YES in Step S6), and compares the maximum value of the temporary integrated density profile in each temporary repetition period (Step S8). When the period length of the temporary repetition period is different from the repetition period length W2, the peak position (see FIG. 7A) of the waveform in each temporary repetition period is deviated; thus, if integration average is performed, the peak is averaged and the maximum value of the temporary integrated density profile becomes small. Accordingly, the repetition period calculation unit 41 determines the temporary repetition period with the greatest maximum value as the repetition period length W2 (Step S9, determination step). With this, it is possible to accurately calculate the repetition period length W2. The repetition period calculation unit 41 outputs the calculation result of the repetition period length W2 to the integrated density profile calculation unit 42 along with the above-described first density profile 53A1.

(Calculation of Integrated Density Profile)

As shown in FIGS. 7A and 7B, the integrated density profile calculation unit 42 integrates and averages the density value of the first density profile 53A1 in each repetition period length W2 to calculate the first integrated density profile 56A. The integrated density profile calculation unit 42 outputs the first integrated density profile 56A to the reference positional deviation amount calculation unit 43.

(Calculation of Reference Amount of Positional Deviation)

Figure 7C:
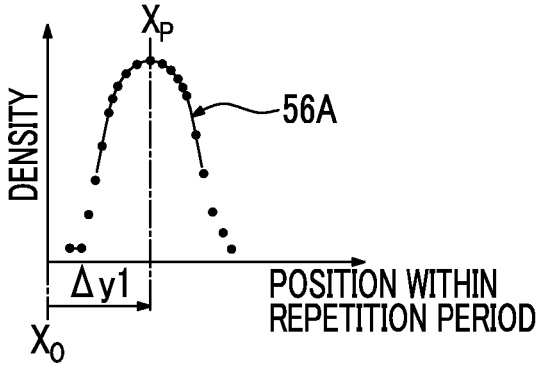
FIG. 7C is an explanatory view illustrating calculation of a reference amount of positional deviation Δy1.

As shown in FIG. 7C, the reference positional deviation amount calculation unit 43 analyzes the first integrated density profile 56A to calculate a reference amount of positional deviation Δy1 of the recording position of the first head module 28A. Hereinafter, a calculation method of the reference amount of positional deviation Δy1 will be specifically described.

Figure 10:
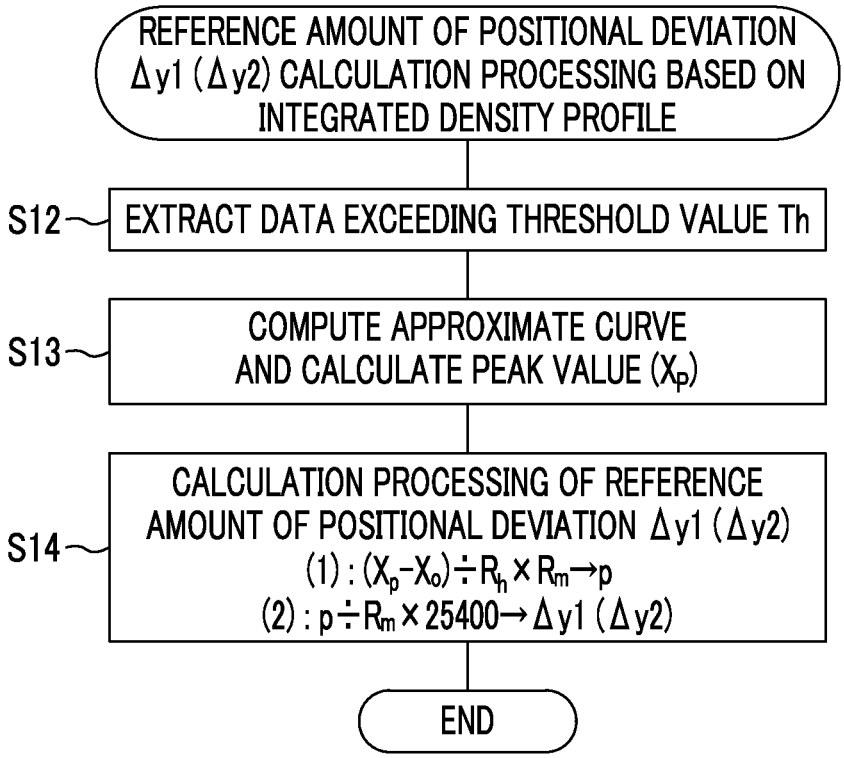
FIG. 10 is a flowchart showing the flow of calculation processing of a reference amount of positional deviation.
Figure 11:
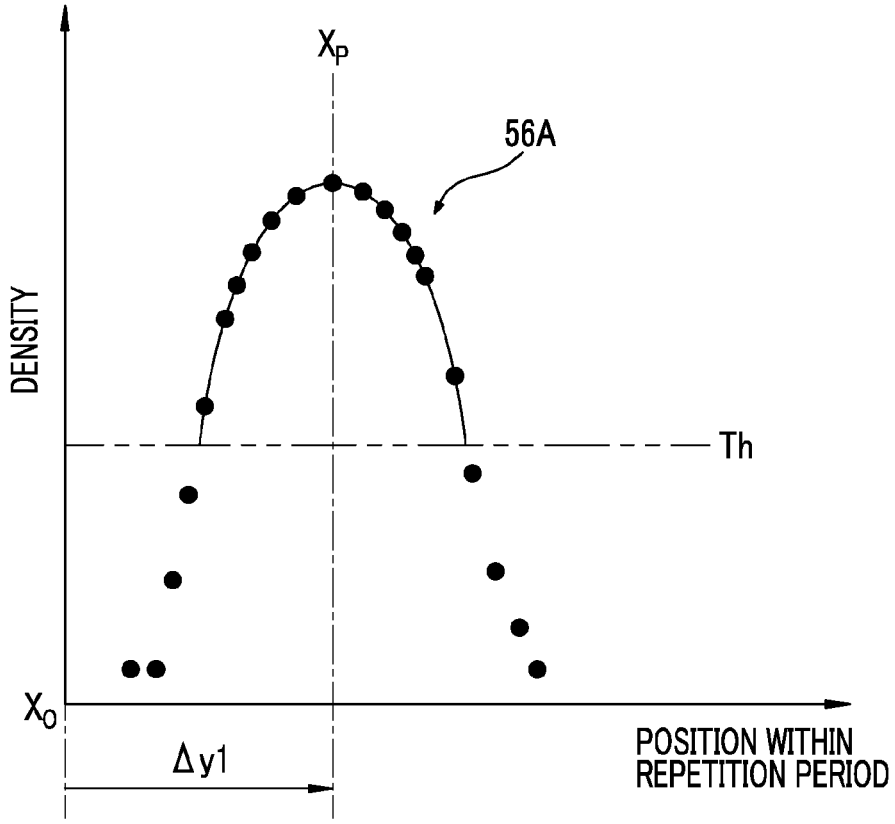
FIG. 11 is an explanatory view illustrating a reference amount of positional deviation Δy1.

As shown in FIGS. 10 and 11, the reference positional deviation amount calculation unit 43 determines a threshold value Th of data of the first integrated density profile 56A using, for example, Expression (2) described below. The reference positional deviation amount calculation unit 43 extracts data exceeding the threshold value Th among data of the first integrated density profile 56A (Step S12).

$$\text{threshold value } Th = (\text{maximum value} - \text{minimum value}) \times f + \text{minimum value: (where } f \text{ is, for example, } 0.5) \quad (2)$$

Next, the reference positional deviation amount calculation unit 43 computes an approximate curve (for example, quadratic function: $y=ax^2+bx+c$, displayed by a solid line in FIG. 11) for data exceeding the threshold value Th, and calculates a peak position (also called an apex value) $X_P$ of the approximate curve (Step S13). For example, the peak position $X_P$ is calculated based on $X_P=-b\div(2\times a)$.

After the calculation of the peak position $X_P$, the reference positional deviation amount calculation unit 43 calculates the reference amount of positional deviation Δy1 based on the peak position $X_P$, the reference position $X_0$ (for example, $X_0=0$), the resolution $R_m$ of the image scanner 16, and the resolution $R_h$ after resolution enhancement using Expressions (3) and (4) described below (Step S14). In Expression (4), "25400" is a conversion factor which converts inches to μm. In the invention, although a position where the waveform of the integrated density profile is maximized is set as a peak position, for example, in the case of an integrated density profile in which data corresponding to a portion with no dot pattern recorded is maximized, a position where the waveform is minimized is set as a peak position (the same applies to other embodiments). The reference positional deviation amount calculation unit 43 outputs the calculation result of the reference amount of positional deviation Δy1 to the positional deviation amount calculation unit 44. With the above, the calculation of the reference amount of positional deviation Δy1 of the recording position of the first head module 28A is completed.

$$(X_P - X_0) \div R_h \times R_m \rightarrow p(\text{pixl/scanner resolution}) \quad (3)$$

$$p \div R_m \times 25400 \rightarrow \Delta y1(\mu\text{m}) \quad (4)$$

<Calculation of Reference Amount of Positional Deviation of Recording Position of Second Head Module>

Figure 12:
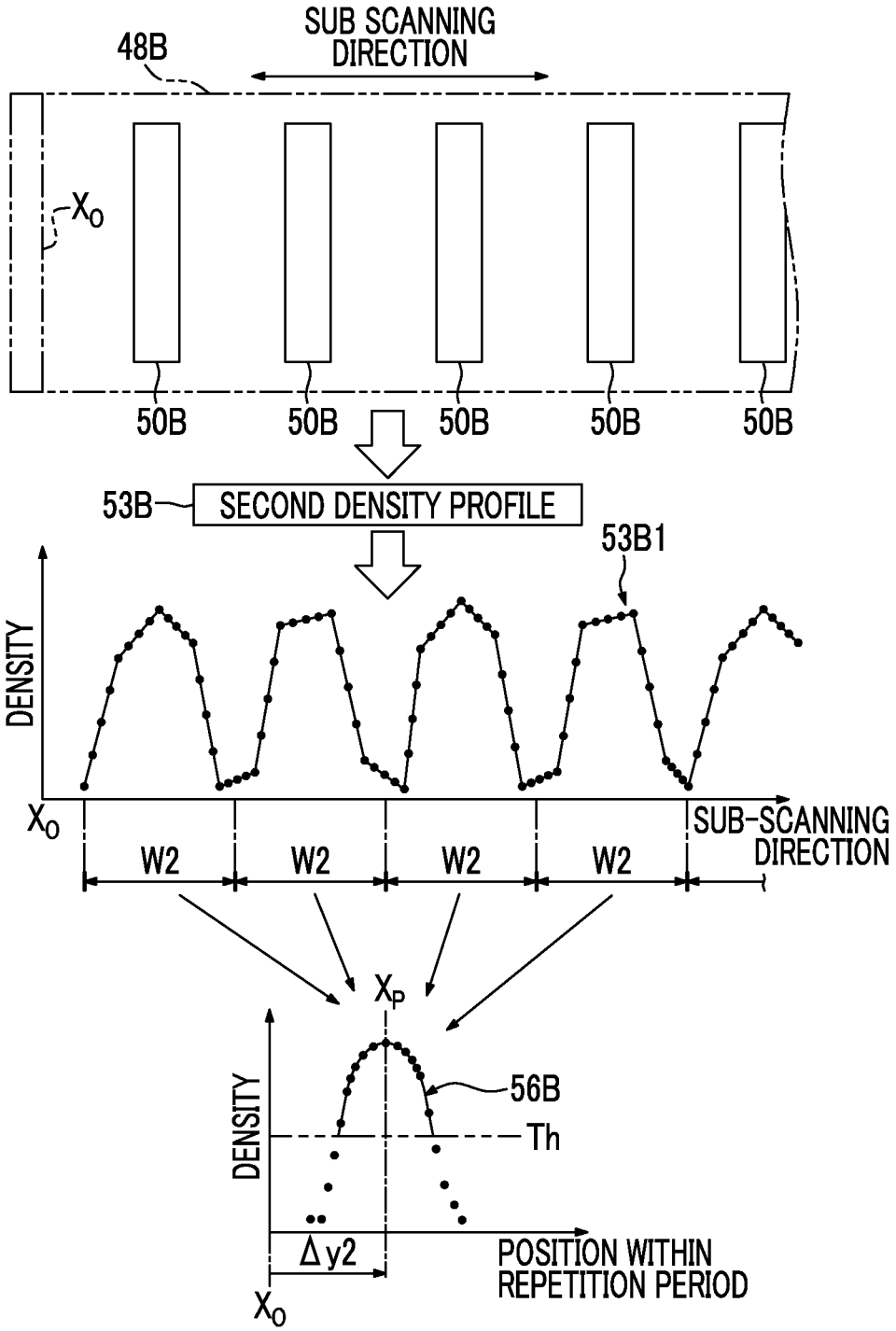
FIG. 12 is an explanatory view illustrating calculation processing of a reference amount of positional deviation Δy2.

Next, as shown in FIG. 12, the respective units 39 to 43 from the density profile data calculation unit 39 to the reference positional deviation amount calculation unit 43 calculate a reference amount of positional deviation Δy2 of the recording position of the second head module 28B. Calculation processing of the reference amount of positional deviation Δy2 is basically the same as the calculation processing of the reference amount of positional deviation Δy1 described above.

The density profile data calculation unit 39 analyzes read image data 32 to calculate a second density profile 53B representing change in density in the sub scanning direction of an image area with the second dot pattern group 48B recorded. The second density profile 53B represents, based on the reference position $X_0$ determined at the time of the calculation of the first density profile 53A described above, change in density of the image area in the sub scanning direction from the reference position $X_0$. That is, the first and second density profiles 53A and 53B represent change in density in the sub scanning direction from the common reference position $X_0$.

The complementary processing unit 40 performs linear complementary processing for the second density profile 53B to enhance the resolution of the second density profile 53B in the sub scanning direction from 100 dpi to 10000 dpi. With this, a resolution-enhanced second density profile 53B 1 is generated.

The repetition period calculation unit 41 calculates the repetition period length W2 representing the repetition period of change in density corresponding to the second dot pattern 50B based on the second density profile 53B1 using the method shown in FIGS. 8 and 9 described above.

The integrated density profile calculation unit 42 integrates and averages data of the second density profile 53B 1 in each repetition period length W2 to calculate a second integrated density profile 56B.

As shown in FIGS. 10 and 11 described above, the reference positional deviation amount calculation unit 43 calculates a peak position $X_P$ of the second integrated density profile 56B and calculates the reference amount of positional deviation Δy2 of the recording position of the second head module 28B based on the peak position $X_P$. The reference positional deviation amount calculation unit 43 outputs the calculation result of the reference amount of positional deviation Δy2 to the positional deviation amount calculation unit 44.

<Positional Deviation Amount Calculation Processing>

As shown in FIG. 13, the positional deviation amount calculation unit 44 calculates the amount of positional deviation ΔY based on the difference between the reference amount of positional deviation Δy1 and the reference amount of positional deviation Δy2, that is, the difference between the peak position $X_P$ corresponding to the first dot pattern 50A and the peak position $X_P$ corresponding to the second dot pattern 50B. Since the reference amounts of positional deviation Δy1 and Δy2 (the peak positions $X_P$) are calculated based on the common reference position $X_0$, it is possible to calculate the amount of positional deviation ΔY of the recording position between the first and second head modules 28A and 28B by taking the difference between both the reference amounts of positional deviation Δy1 and Δy2. The positional deviation amount calculation unit 44 outputs the calculation result of the amount of positional deviation ΔY to the positional deviation correction processing unit 45. The amount of positional deviation ΔY is the amount of positional deviation of the recording position including the amount of deviation from a design position shown in FIG. 3, the amount of deviation due to zigzag arrangement, and an error of the ink ejection timing set in each head module at the time of recording of the test chart.

<Positional Deviation Correction Processing>

Returning to FIG. 4, the positional deviation correction processing unit 45 performs positional deviation correction processing for correcting the recording position between the first and second head modules 28A and 28B based on the detection result of the amount of positional deviation ΔY. For example, the positional deviation correction processing unit 45 controls the post-processing arithmetic unit 21 to perform positional deviation correction processing on print data, thereby advancing or delaying the recording start timing of one of the first and second head modules 28A and 28B to the other head module. With this, the positional deviation of the recording position between the first and second head modules 28A and 28B is corrected. Various methods are known as a positional deviation correction method which corrects the positional deviation of the recording position between the head modules, and any method may be used.

Operation of Ink Jet Printer of First Embodiment

Next, the operation of the printer 10 having the above-described configuration, in particular, measurement processing of the amount of positional deviation ΔY and image recording processing will be described. Here, a case of measuring the amount of positional deviation ΔY of the recording position between the first and second head modules 28A and 28B will be described.

Figure 14:
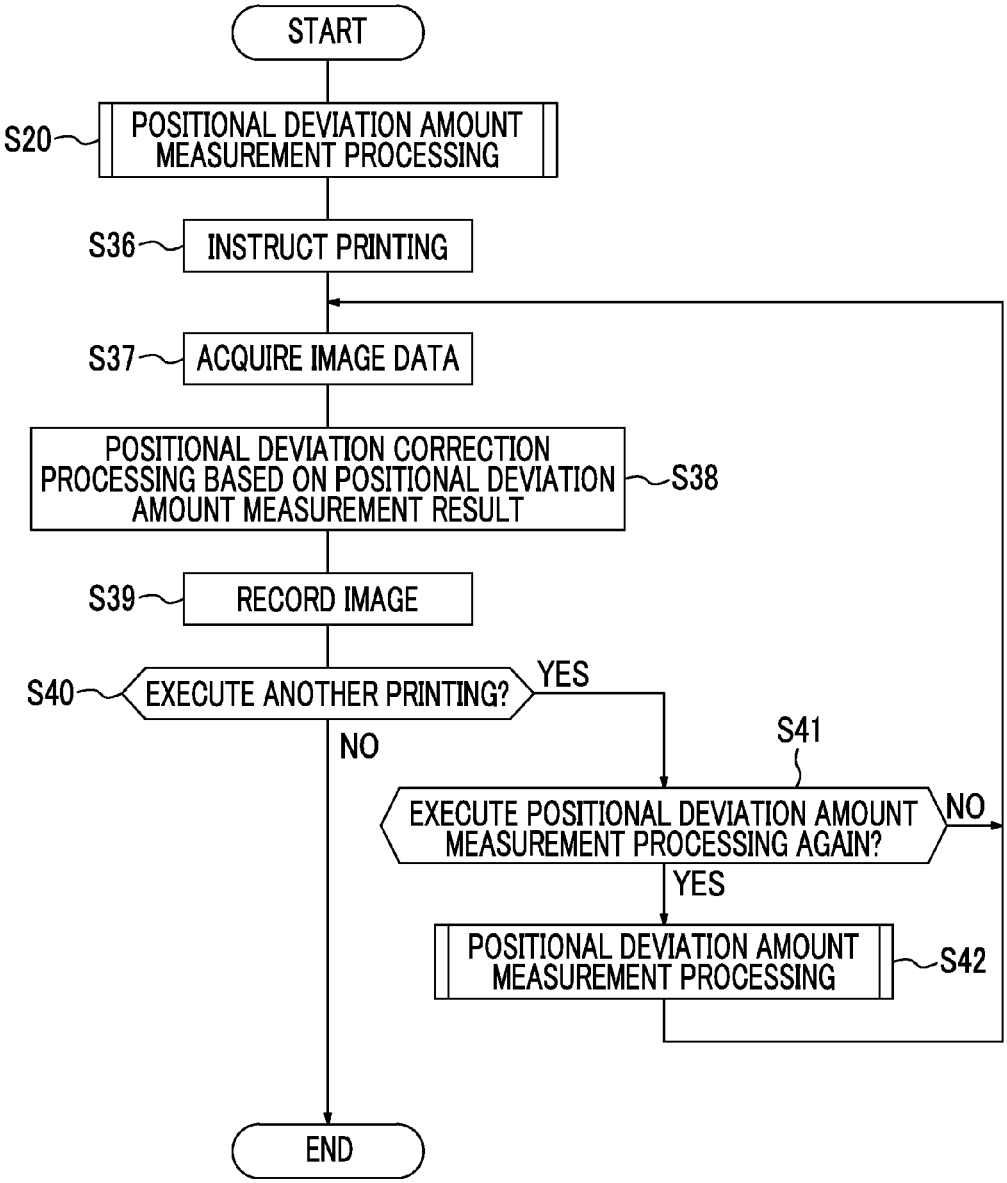
FIG. 14 is a flowchart showing the flow of image recording processing of a printer of the first embodiment.

As shown in FIG. 14, when the printer 10 is powered on, when at least one of the first and second head modules 28A and 28B is newly mounted in the recording head 14, or the like, the respective units 39 to 45 of the CPU 24 are operated to start the measurement processing of the amount of positional deviation ΔY (Step S20).

(Test Chart Recording Processing)

Figure 15:
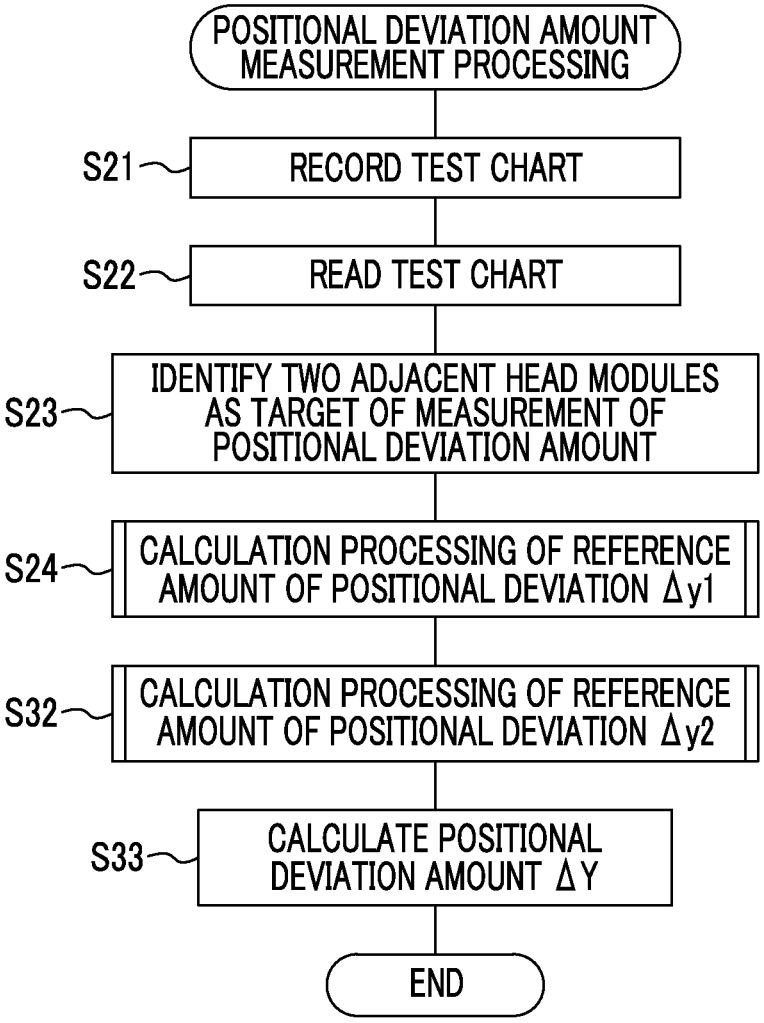
FIG. 15 is a flowchart showing the flow of positional deviation amount measurement processing of the first embodiment.

As shown in FIG. 15, test chart data 35 in the memory 34 is output to the image page memory 18, and then, print data for single deposition based on test chart data 35 is successively transferred to the head driver 23 through the image buffer memory write control unit 19, the image buffer memory 20, and the transfer control unit 22 under the control of the test chart recording control unit 38. The head driver 23 controls ink ejection of the nozzles 27 of the head modules 28A to 28C based on print data. Then, the ink droplets 36 are deposited by the head modules 28A to 28C while transporting the recording sheet 13 in the sub scanning direction by the transport mechanism 12, whereby the test chart 31 is recorded on the recording surface of the recording sheet 13 (Step S21, recording step).

(Test Chart Reading Processing)

After the recording of the test chart 31, the CPU 24 tracks the test chart 31 based on known transport speed information of the recording sheet 13. The CPU 24 starts reading by the image scanner 16 in matching with the timing when the test chart 31 passes through the image scanner 16. With this, the test chart 31 is read by the image scanner 16, and read image data 32 is output from the image scanner 16 to the density profile data calculation unit 39 (Step S22, reading step).

After the input of read image data 32, the density profile data calculation unit 39 identifies two head modules as a target of measurement of the amount of positional deviation ΔY, that is, the first and second head modules 28A and 28B (Step S23). Next, the calculation processing of the reference amount of positional deviation Δy1 of the recording position of the first head module 28A is started (Step S24).

(Calculation Processing of Reference Amount of Positional Deviation Δy1)

Figure 16:
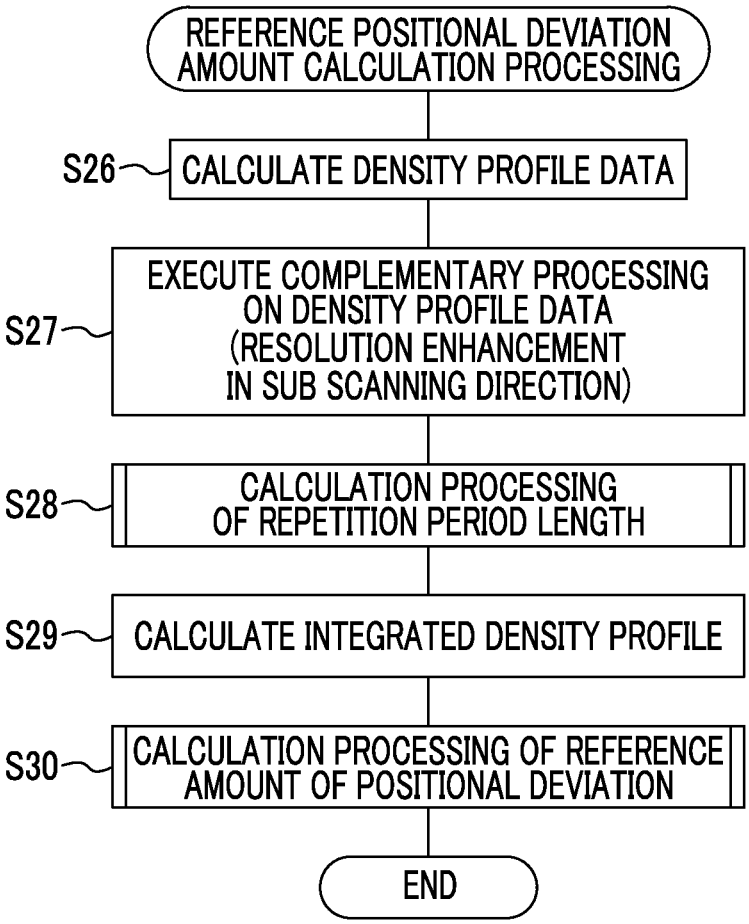
FIG. 16 is a flowchart showing the flow of reference positional deviation amount measurement processing.

As shown in FIG. 16, the density profile data calculation unit 39 analyzes read image data 32 to calculate the first density profile 53A shown in FIG. 6B (Step S26, density profile calculation step). The first density profile 53A is output from the density profile data calculation unit 39 to the complementary processing unit 40.

The complementary processing unit 40 performs the linear complementary processing for the first density profile 53A to generate the resolution-enhanced first density profile 53A1, as shown in FIG. 6C (Step S27, complementary processing step). The resolution of the first density profile 53A is enhanced in the sub scanning direction, whereby it is possible to calculate the reference amount of positional deviation Δy1 (that is, the amount of positional deviation ΔY) with higher accuracy. The first density profile 53A1 is output from the complementary processing unit 40 to the repetition period calculation unit 41.

The repetition period calculation unit 41 executes the processing of Step S1 to Step S9 shown in FIG. 8, whereby the repetition period length W2 representing the repetition period of change in density corresponding to the first dot pattern 50A is calculated, as shown in FIG. 7A (Step S28, repetition period calculation step). The repetition period length W2 is accurately calculated, whereby it is possible to accurately calculate the peak position $X_P$ of the first integrated density profile 56A. The calculation result of the repetition period length W2 is output from the repetition period calculation unit 41 to the integrated density profile calculation unit 42 along with the first density profile 53A1.

As shown in FIG. 7B, the integrated density profile calculation unit 42 integrates and averages data of the first density profile 53A1 in each repetition period length W2 to calculate the first integrated density profile 56A (Step S29, integrated density profile calculation step). The first integrated density profile 56A is output from the integrated density profile calculation unit 42 to the reference positional deviation amount calculation unit 43.

The reference positional deviation amount calculation unit 43 executes the processing of Step S12 to Step S14 shown in FIG. 10, whereby the reference amount of positional deviation Δy1 of the recording position of the first head module 28A is calculated, as shown in FIGS. 7C and 11 (Step S30). The calculation result of the reference amount of positional deviation Δy1 is output from the reference positional deviation amount calculation unit 43 to the positional deviation amount calculation unit 44. With the above, the calculation processing (Step S24, see FIG. 15) of the reference amount of positional deviation Δy1 is completed.

(Calculation Processing of Reference Amount of Positional Deviation Δy2)

Returning to FIG. 15, after the calculation processing of the reference amount of positional deviation Δy1, the calculation processing of the reference amount of positional deviation Δy2 of the recording position of the second head module 28B is started (Step S32). In the calculation processing of the reference amount of positional deviation Δy2, the processing of Step S26 to Step S30 shown in FIG. 16 is executed again. With this, after the calculation of the second density profile 53B shown in FIG. 12, the generation of the second density profile 53B1, the calculation of the repetition period length W2, and the calculation of the second integrated density profile 56B are performed, the reference amount of positional deviation Δy2 of the recording position of the second head module 28B is calculated. The calculation result of the reference amount of positional deviation Δy2 is output to the positional deviation amount calculation unit 44.

(Calculation Processing of Amount of Positional Deviation ΔY)

As shown in FIG. 13, the positional deviation amount calculation unit 44 calculates the amount of positional deviation ΔY based on the difference between the reference amount of positional deviation Δy1 and the reference amount of positional deviation Δy2 (the difference between the peak position $X_P$ corresponding to the first dot pattern 50A and the peak position $X_P$ corresponding to the second dot pattern 50B) (Step S33, positional deviation amount calculation step). The calculation result of the amount of positional deviation ΔY is output from the positional deviation amount calculation unit 44 to the positional deviation correction processing unit 45. With the above, the positional deviation amount measurement processing (Step S20, see FIG. 14) is completed.

The amount of positional deviation ΔY of the recording position between the second and third head modules 28B and 28C can be measured in the same manner.

(Positional Deviation Correction Processing)

Returning to FIG. 14, if a printing start operation is performed by an operating unit (not shown) or the like (Step S36), image data sent from the host computer 11 is stored in the image page memory 18 through the host I/F unit 17 (Step S37). Then, print data for single deposition based on image data is successively transferred to the head driver 23 under the control of the CPU 24. At this time, positional deviation correction processing unit 45 controls the post-processing arithmetic unit 21 based on the detection result of the amount of positional deviation ΔY to perform the positional deviation correction processing for print data. With this, the positional deviation of the recording position between the first and second head modules 28A and 28B is corrected (Step S38).

The head driver 23 controls ink ejection of the nozzles 27 of the head modules 28A to 28C based on print data. Then, the ink droplets 36 are deposited by the head modules 28A to 28C while transporting the recording sheet 13 in the sub scanning direction by the transport mechanism 12. With this, an image based on image data is recorded on the recording surface of the recording sheet 13 (Step S39).

When performing printing again based on another piece of image data (YES in Step S40), the processing of Step S37 to Step S39 described above is repeatedly executed.

At this time, when replacing the first and second head modules 28A and 28B, when a predetermined time has elapsed after the amount of positional deviation ΔY is measured, or when a predetermined number of sheets are printed, and when an instruction to re-measure the amount of positional deviation ΔY is received from the user, or the like, the measurement processing of the amount of positional deviation ΔY is executed again (YES in Step S41, Step S42). With this, the processing of Step S21 to Step S30 shown in FIGS. 15 and 16 described above is repeatedly executed, whereby a new amount of positional deviation ΔY is measured.

Hereinafter, the processing of the respective steps described above is repeatedly executed until printing in the printer 10 ends.

Functional Effects of Ink Jet Printer of First Embodiment

In this way, in this embodiment, since the first and second integrated density profiles 56A and 56B are calculated based on the read image of the test chart 31, and the amount of positional deviation ΔY is measured based on the first and second integrated density profiles 56A and 56B, it is possible to measure the amount of positional deviation of the recording position between the head module at low cost and with high accuracy without using a high-resolution image sensor.

Ink Jet Printer of Second Embodiment

Figure 17:
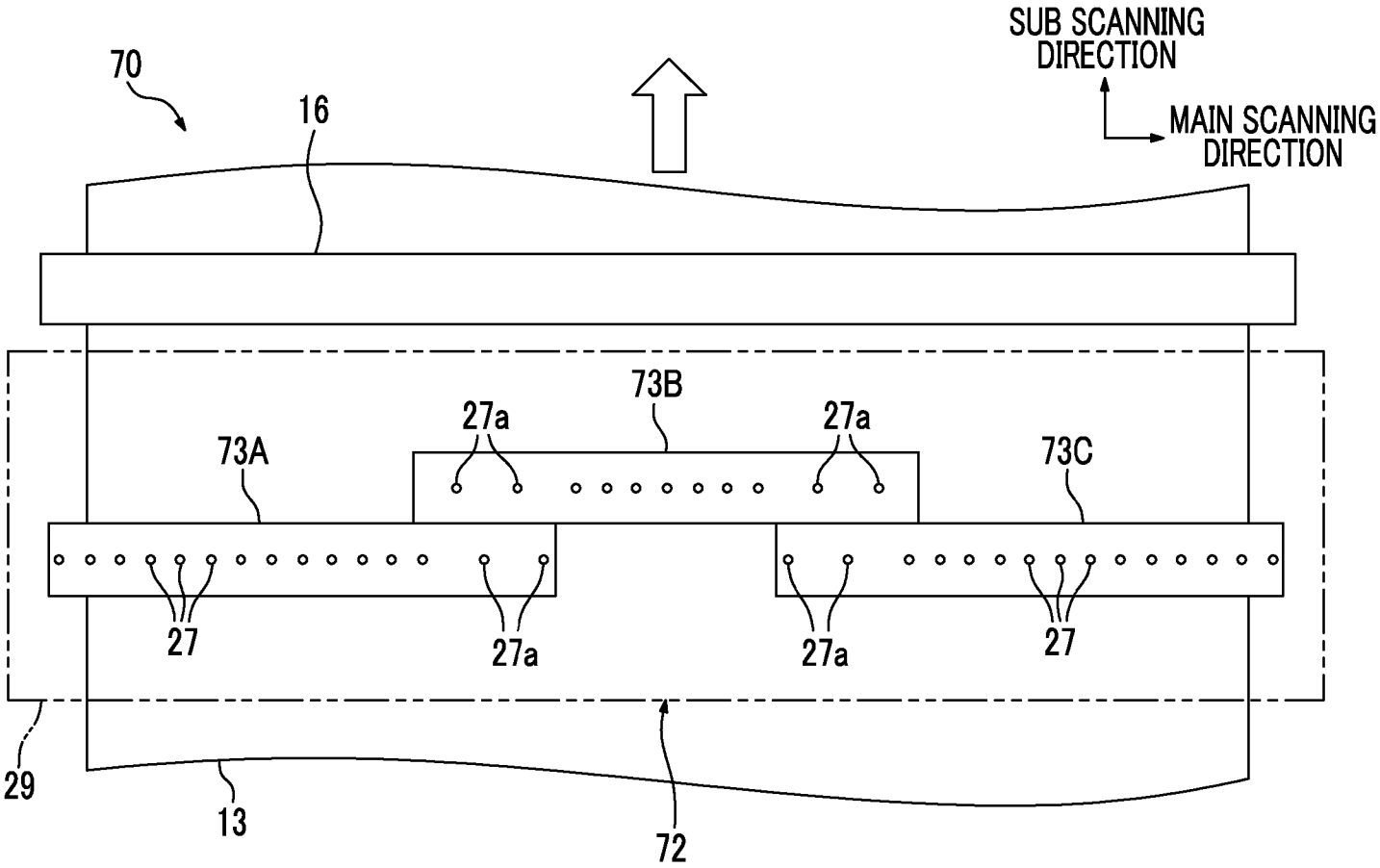
FIG. 17 is a top view of a recording head of an ink jet printer of a second embodiment.

Next, a printer 70 according to a second embodiment of the invention will be described referring to FIG. 17. In the above-described first embodiment, although the recording areas where the head modules 28A to 28C perform recording on the recording sheet 13 do not overlap one another, in the printer 70, the recording areas of adjacent head modules overlap each other. The printer 70 basically has the same configuration as the printer 10 of the first embodiment, except that a recording head 72 different from the first embodiment is provided. For this reason, the parts having the same functions and configurations as those in the first embodiment are represented by the same reference numerals, and description thereof will not be repeated.

The recording head 72 includes three replaceable head modules of a first head module 73A, a second head module 73B, and a third head module 73C, and a frame body 29. The head modules 73A to 73C are arranged in zigzag in the main scanning direction. The end portions of two adjacent head modules among the head modules 73A to 73C overlap each other. The head modules 73A to 73C correspond to a first head module and a second head module of the invention. The recording head 72 may also include tow or, or four or more replaceable head modules of a first head module 73A.

Part of nozzles 27*a* of the first head module 73A and the second head module 73B are arranged so as to overlap each other in the main scanning direction. Part of nozzles 27*a* of the second head module 73B and the third head module 73C are arranged so as to overlap each other in the main scanning direction. With this, the recording area of the first head module 73A and the recording area of the second head module 73B partially overlap each other, and the recording area of the second head module 73B and the recording area of the third head module 73C partially overlap each other. Hereinafter, the overlap area of the recording areas is referred to as an "overlap recording area", and a recording area other than the overlap recording area is referred to a "non-overlap recording area".

Figure 18:
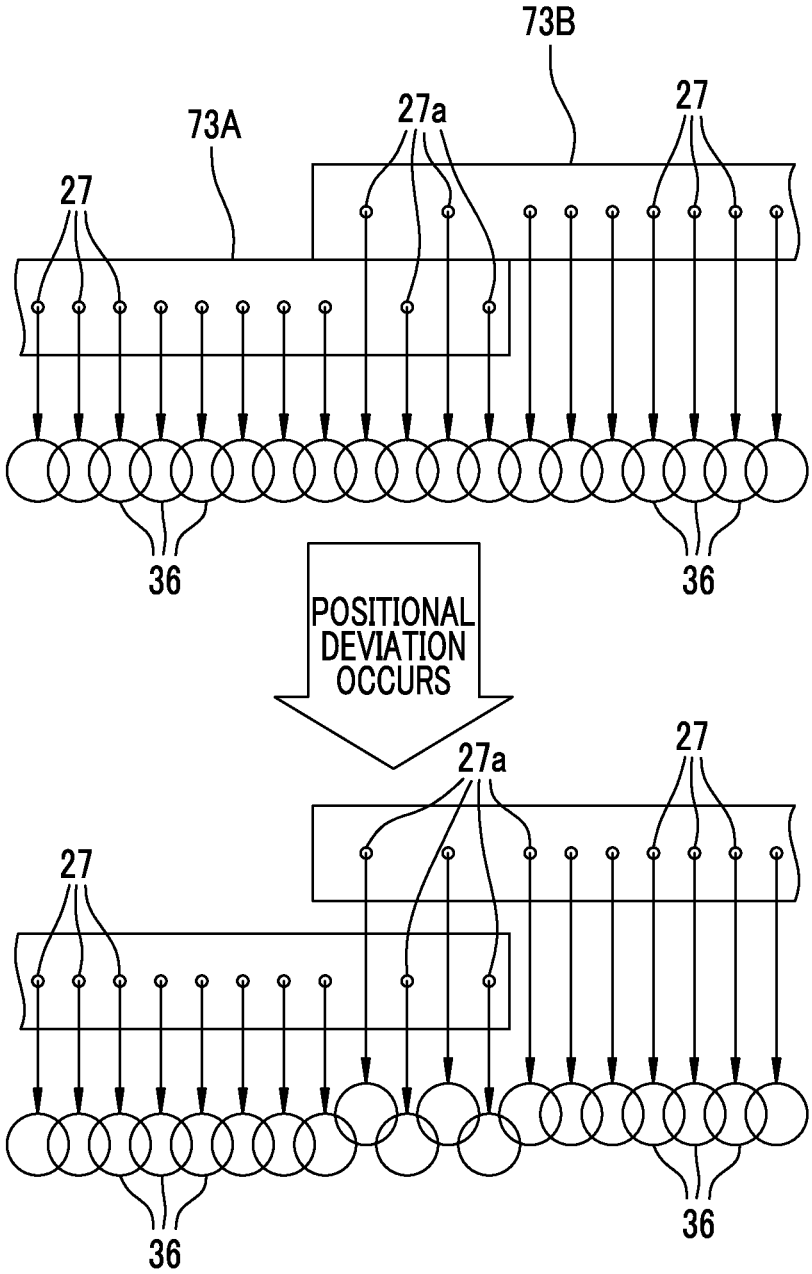
FIG. 18 is an explanatory view illustrating positional deviation of a recording position of the second embodiment.

As shown in FIG. 18, as in the first embodiment shown in FIG. 3, the positional deviation of the recording position among the head modules 73A to 73C occurs due to the positional deviation of the head modules 73A to 73C, or flight deflection of the ink droplets 36 (not shown).

A measurement method of the amount of positional deviation ΔY of the recording position among the head modules 73A to 73C is basically the same as the measurement method described in the first embodiment, except that a test chart 75 (see FIG. 19) different from that in the first embodiment is recorded on the recording sheet 13.

As in the first embodiment, the test chart recording control unit 38 outputs test chart data 35 to the image page memory 18 and operates the image buffer memory write control unit 19, the transfer control unit 22, and the head driver 23 to execute recording of the test chart 75. However, at this time, the test chart recording control unit 38 inhibits (stops) ejection of the ink droplets 36 from the nozzles 27*a*. That is, the test chart 75 is recorded in the non-overlap area only by the nozzles 27 of the head modules 73A to 73C.

Figure 19:
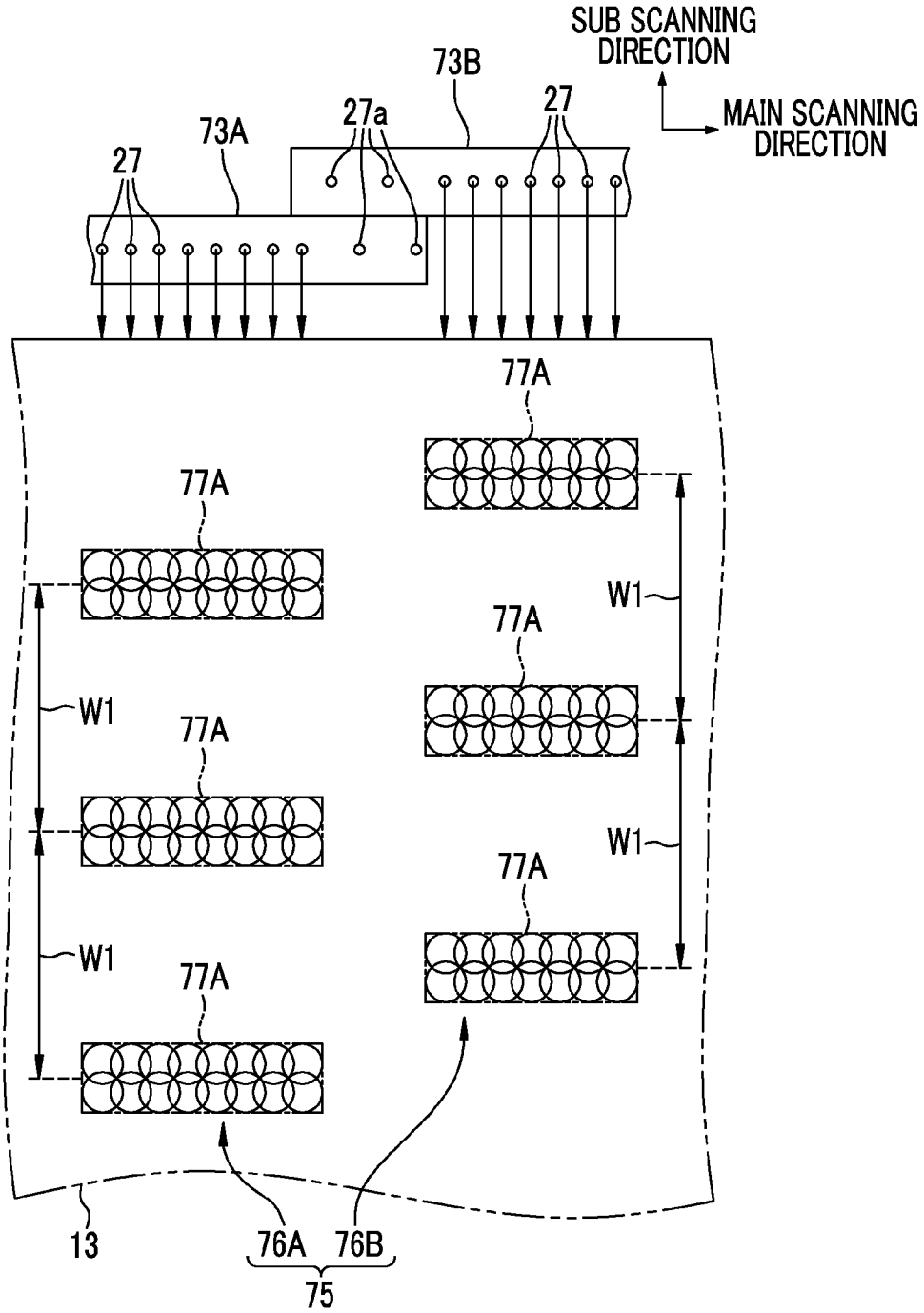
FIG. 19 is a schematic view of a test chart of the second embodiment.

As shown in FIG. 19, the test chart 75 includes a first dot pattern group 76A, a second dot pattern group 76B, and a third dot pattern group (not shown) recorded only by the nozzles 27 of the head modules 73A to 73C. The first dot pattern group 76A has, for example, 150 first dot patterns 77A having a shape extended long in the main scanning direction at pattern intervals W1 (repetition period) in the sub scanning direction.

The second dot pattern group 76B has, for example, 150 second dot patterns 77B having the same shape as the first dot patterns 77A at the pattern intervals W1 (repetition period) in the sub scanning direction. Each second dot pattern 50B is recorded to be deviated from the first dot pattern 50A by an amount according to the positional deviation between the first and second head modules 73A and 73B in the sub scanning direction.

The third dot pattern group has, for example, 150 third dot patterns (not shown) having the same shape as the first dot patterns 77A at the pattern intervals W1 in the sub scanning direction. The dot patterns 77A and 77B correspond to a first dot pattern and a second dot pattern of the invention.

In this way, the test chart 75 is the same as the test chart 31 of the first embodiment, except that the first and the second dot patterns 77A and 77B are different in length in the main scanning direction. Accordingly, as in first embodiment, the processing of Step S21 to Step S33 shown in FIGS. 15 and 16 is executed by the respective units of the CPU 24, whereby it is possible to calculate the amount of positional deviation ΔY of the recording position between two head modules among the head modules 73A to 73C. It is also possible to correct the positional deviation based on the calculation result of the amount of positional deviation ΔY. With this, the same effects as the above-described first embodiment are obtained.

Ink Jet Printer of Third Embodiment

<Configuration of Ink Jet Printer>

Figure 20:
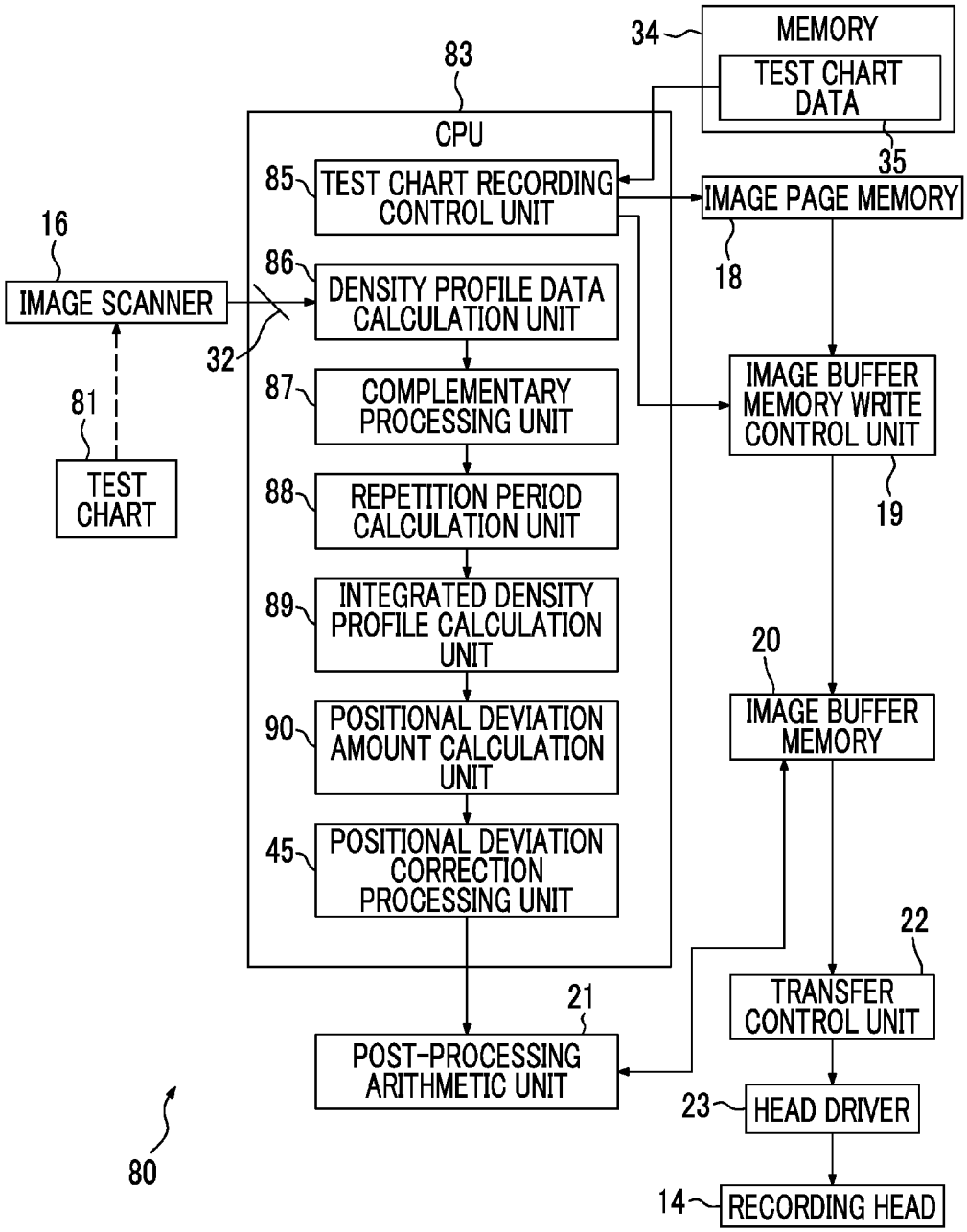
FIG. 20 is a functional block diagram of a CPU of an ink jet printer of the third embodiment.

Next, a printer 80 according to a third embodiment of the invention will be described referring to FIG. 20. In the above-described second embodiment, the test chart 75 is recorded only by the nozzles 27 of the head modules 73A to 73C. In contrast, in the printer 80, a test chart 81 is recorded in the overlap recording area of the recording sheet 13 using only the nozzles 27*a* of the head modules 73A to 73C, and the amount of positional deviation ΔY is measured based on the read image of the test chart 81.

The printer 80 basically has the same configuration as the printer 10 of the first embodiment, except that a CPU 83 and a recording head 72 different from those in the first embodiment are provided. The recording head 72 of the printer 80 has the same configuration as the recording head 72 of the second embodiment. For this reason, the parts having the same functions and configurations as those in the first and second embodiments are represented by the same reference numerals, and description thereof will not be repeated.

<Configuration Relating to Measurement of Amount of Positional Deviation>

The CPU 83 reads and executes a program relating to measurement of the amount of positional deviation ΔY or positional deviation correction from the memory 34 to function as a test chart recording control unit (recording control unit) 85, a density profile data calculation unit 86, a complementary processing unit 87, a repetition period calculation unit 88, an integrated density profile calculation unit 89, a positional deviation amount calculation unit 90, and a positional deviation correction processing unit 45.

(Recording of Test Chart)

Similarly to the test chart recording control unit 38 of the first embodiment, the test chart recording control unit 85 outputs test chart data 35 to the image page memory 18 and operates the image buffer memory write control unit 19, the transfer control unit 22, and the head driver 23 to execute recording of the test chart 81. However, at this time, the test chart recording control unit 85 inhibits (stops) ejection of the ink droplets 36 from the nozzles 27. That is, the test chart 81 is recorded in an overlap recording area (OLA) (see FIG. 21) only by the nozzles 27*a* of the head modules 73A to 73C.

Figure 21:
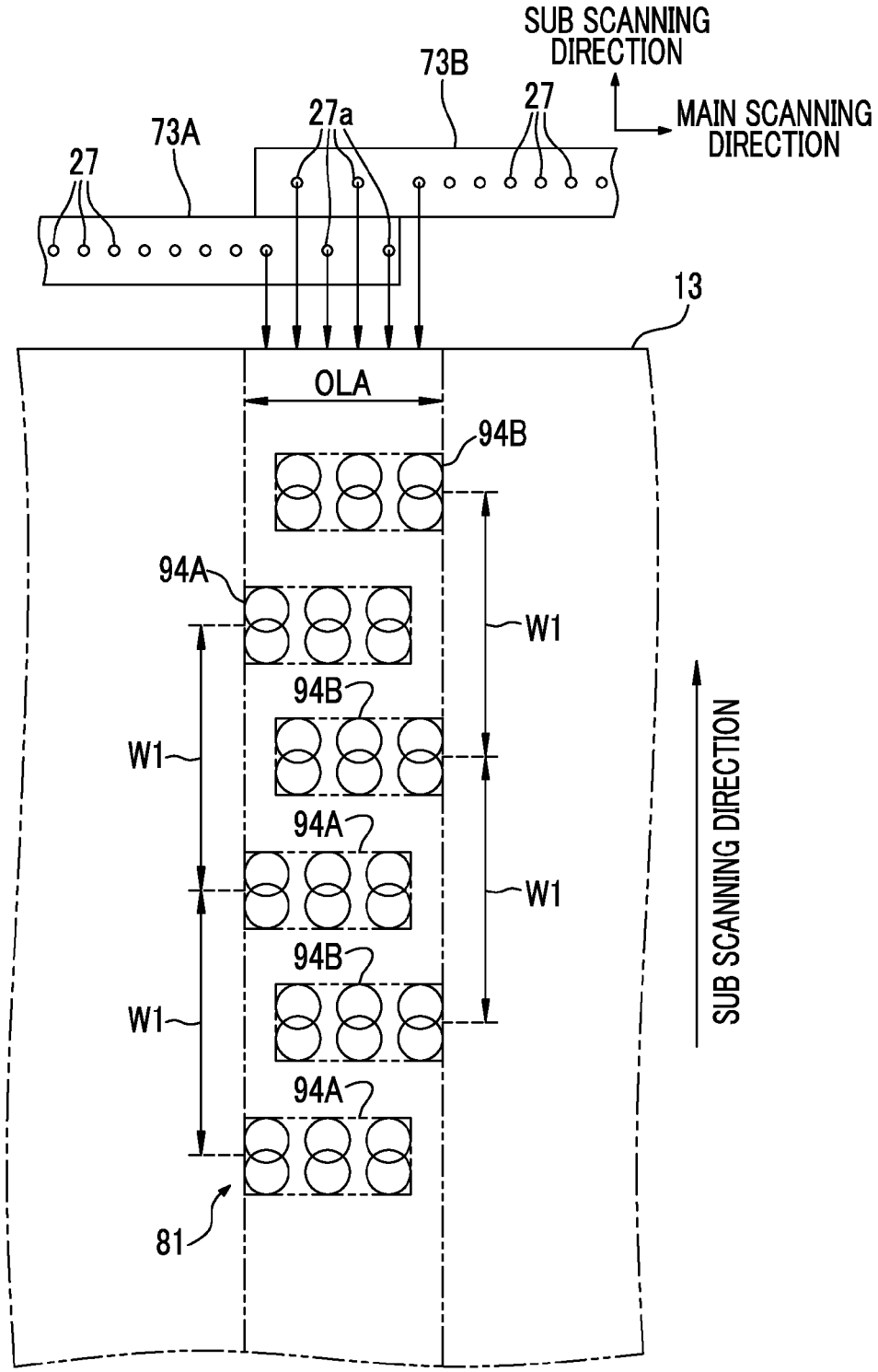
FIG. 21 is a schematic view of a test chart of the third embodiment.

As shown in FIG. 21, the test chart 81 includes first dot patterns 94A which are recorded by the nozzles 27*a* of the first head module 73A, second dot patterns 94B which are recorded by the nozzles 27*a* of the second head module 73B, and third dot patterns (not shown) which are recorded by the nozzles 27*a* of the third head module 73C. The dot patterns 94A and 94B have a shape extended long in the main scanning direction and correspond to a first dot pattern and a second dot pattern of the invention. For example, 150 first and second dot patterns 94A and 94B are recorded at pattern intervals W1 (repetition period) in the sub scanning direction. Simultaneously, the first and second dot patterns 94A and 94B are recorded alternately in the sub scanning direction. Though not shown, the same applies to the second dot patterns 94B and the third dot patterns.

(Calculation of Density Profile)

Figure 22A:
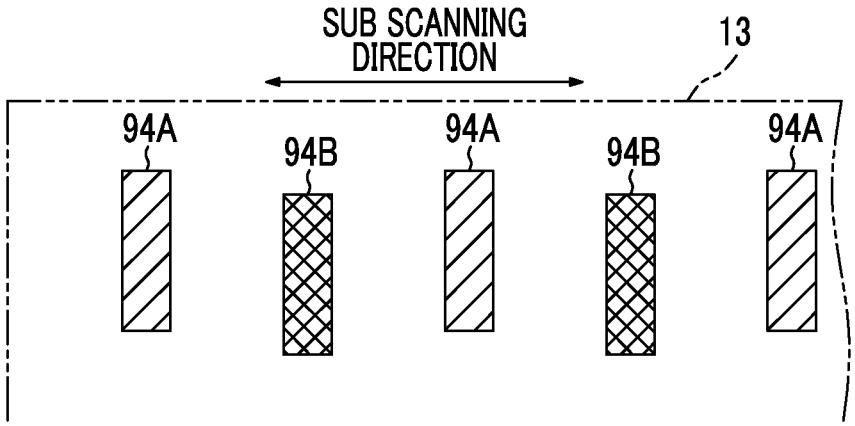
FIGS. 22A and 22B are explanatory views illustrating calculation of a third density profile.
Figure 22B:
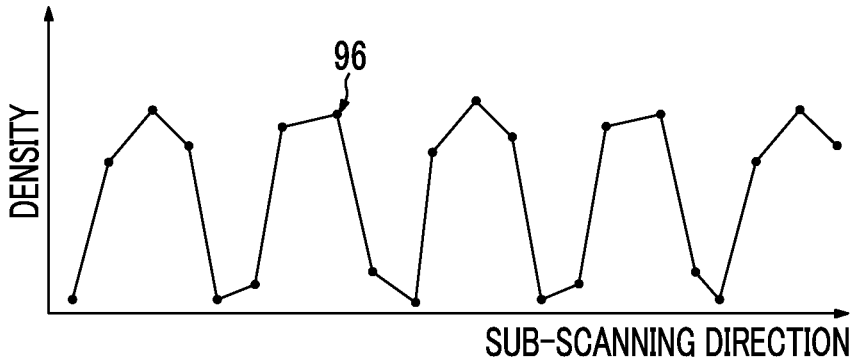

As shown in FIGS. 22A and 22B, the density profile data calculation unit 86 analyzes read image data 32 of the test chart 81 acquired from the image scanner 16 to calculate a third density profile 96 representing change in density in the sub scanning direction of the overlap recording area OLA of the recording sheet 13. In the third density profile 96, the density at a position corresponding to each of the first and second dot patterns 94A and 94B becomes higher, and conversely, the density at a position corresponding to between the first and second dot patterns 94A and 94B becomes lower. As in the first embodiment, since the resolution of the image scanner 16 in the sub scanning direction is low, the resolution of the third density profile 96 in the sub scanning direction also becomes low. The density profile data calculation unit 86 outputs the third density profile 96 to the complementary processing unit 87.

(Complementary Processing)

Figure 22C:
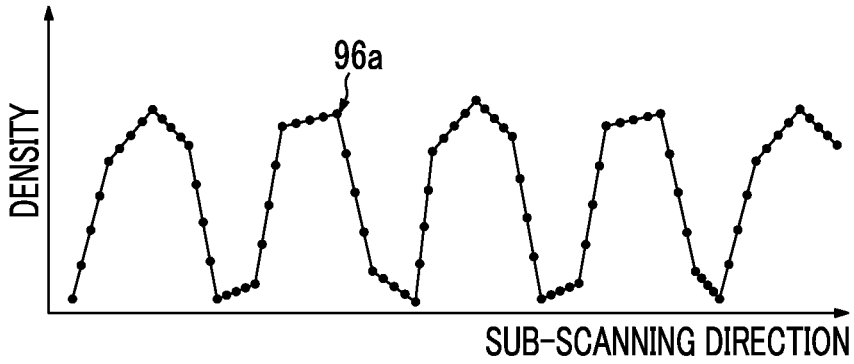
FIG. 22C is an explanatory view illustrating complementary processing.

As shown in FIG. 22C, the complementary processing unit 87 performs the same linear complementary processing as in the first embodiment for the third density profile 96 to enhance the resolution of the third density profile 96 in the sub scanning direction from 100 dpi to 10000 dpi. The resolution of the third density profile 96 is enhanced in the sub scanning direction, whereby it is possible to calculate the amount of positional deviation ΔY with higher accuracy. The complementary processing unit 40 outputs a resolution-enhanced third density profile 96*a* to the repetition period calculation unit 88.

Figure 23A:
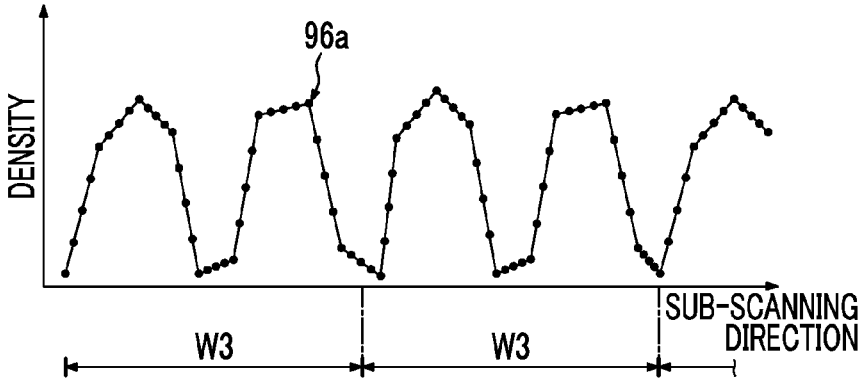
FIG. 23A is an explanatory view illustrating calculation of a repetition period length.

As shown in FIG. 23A, the repetition period calculation unit 88 calculates a repetition period length W3 representing a repetition period of change in density corresponding to the first and second dot patterns 94A and 94B adjacent to each other based on the third density profile 96. Similarly to the calculation method of the first embodiment shown in FIGS. 8 and 9, the repetition period length W3 can be calculated by calculating a temporary integrated density profile in each temporary repetition period and comparing the maximum value of each temporary integrated density profile. The "maximum value" of each temporary integrated density profile is a total value of two peak values shown in FIG. 23C. The repetition period calculation unit 88 outputs the calculation result of the repetition period length W3 to the integrated density profile calculation unit 89 along with the third density profile 96*a*.

Figure 23B:
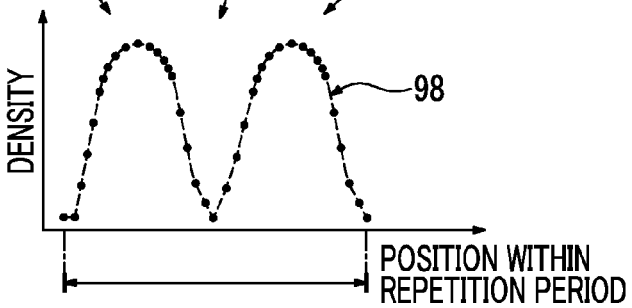
FIG. 23B is an explanatory view illustrating calculation of a third integrated density profile.

As shown in FIG. 23B, the integrated density profile calculation unit 89 integrates and averages data of the third density profile 96*a* in each repetition period length W3 to calculate a third integrated density profile 98. The integrated density profile calculation unit 89 outputs the third integrated density profile 98 to the positional deviation amount calculation unit 90.

Figure 23C:
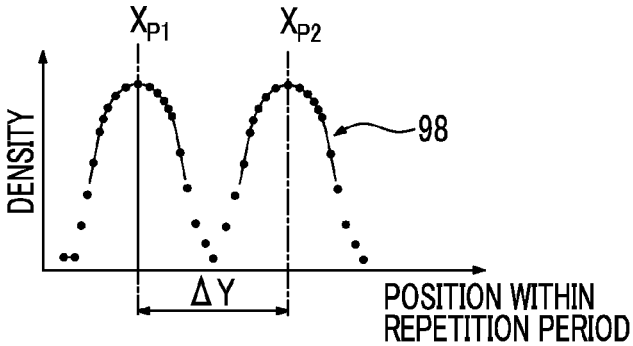
FIG. 23C is an explanatory view illustrating calculation of an amount of positional deviation ΔY.

As shown in FIG. 23C, the positional deviation amount calculation unit 90 analyzes the third integrated density profile 98 to calculate the amount of positional deviation ΔY between the recording position of the first head module 73A and the recording position of the second head module 73B. Hereinafter, a calculation method of the amount of positional deviation ΔY based on the third integrated density profile 98 will be specifically described.

Figure 24:
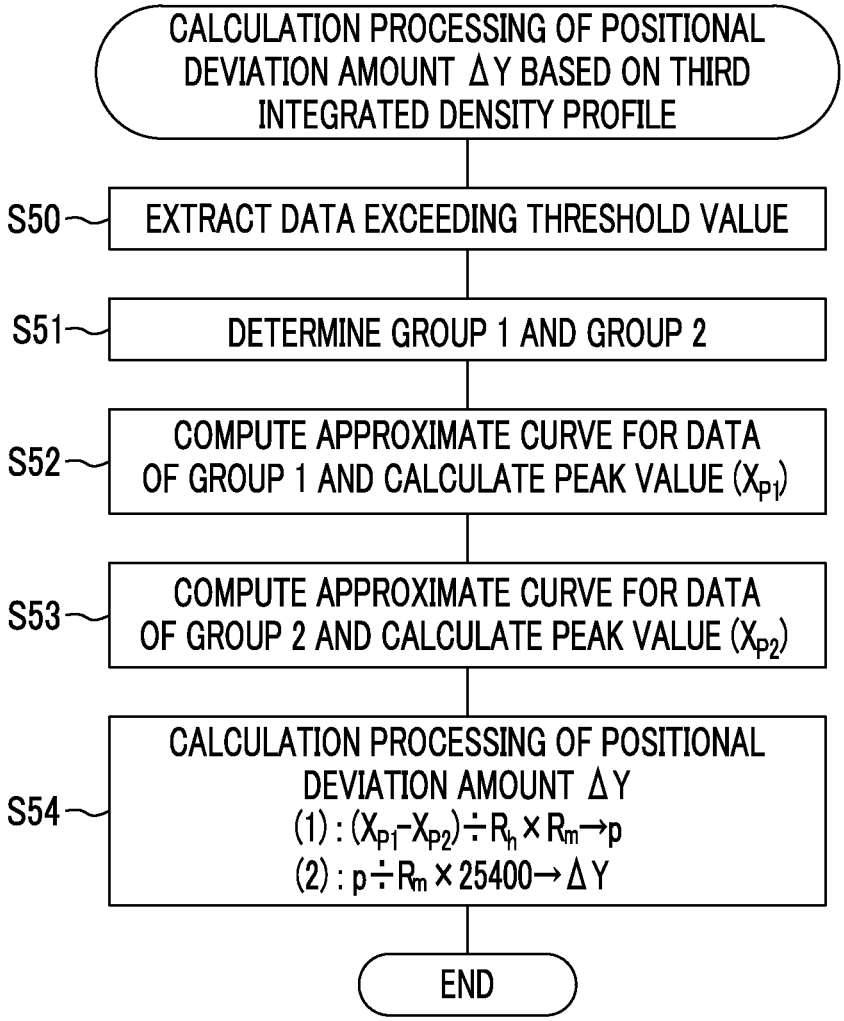
FIG. 24 is a flowchart showing the flow of calculation processing of the amount of positional deviation ΔY.
Figure 25:
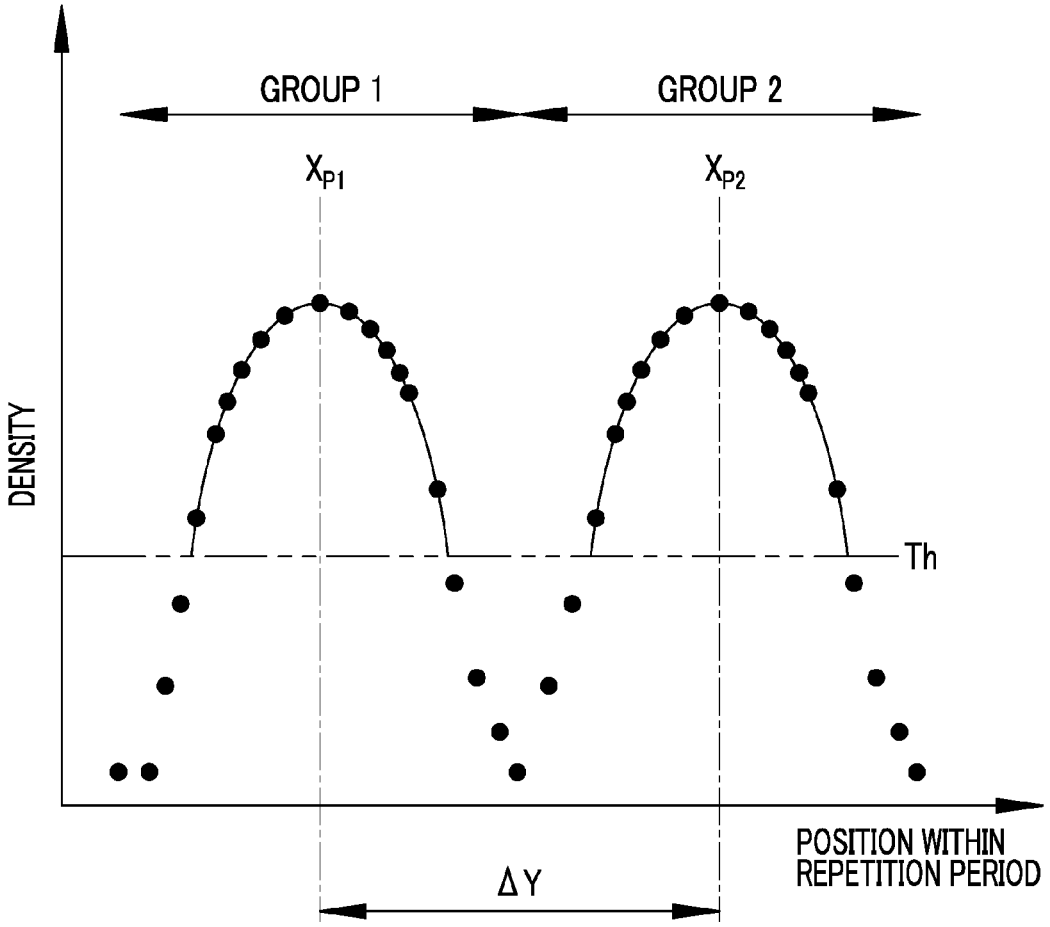
FIG. 25 is an explanatory view specifically illustrating calculation of the amount of positional deviation ΔY.

As shown in FIGS. 24 and 25, the positional deviation amount calculation unit 90 determines a threshold value Th of data of the third integrated density profile 98 using Expression (2) described in the above-described first embodiment. Then, the positional deviation amount calculation unit 90 extracts data exceeding the threshold value Th among data of the third integrated density profile 98 (Step S50).

Next, the positional deviation amount calculation unit 90 obtains an average value of X values (integrated phase values: positions within the repetition period) exceeding the threshold value Th, sets data with the X value smaller than the average value as a "group 1", and conversely, sets data greater than the average value as a "group 2" (Step S51). In this embodiment, the group 1 is data corresponding to the first dot patterns 94A, and the group 2 is data corresponding to the second dot patterns 94B.

The positional deviation amount calculation unit 90 computes an approximate curve (for example, quadratic function: $y=ax^2+bx+c$, displayed by a solid line in FIG. 25) for data of the group 1 and calculates a peak position $X_{P1}$ of the approximate curve (Step S52). The peak position $X_{P1}$ is calculated based on, for example, $X_{P1}=-b\div(2\times a)$.

The positional deviation amount calculation unit 90 computes the approximate curve for data of the group 2 and calculates a peak position $X_{P2}$ of the approximate curve similarly to the calculation of the peak position $X_{P1}$ (Step S53). The peak position $X_{P2}$ is also calculated based on, for example, $X_{P2}=-b\ (2\times a)$.

Next, the positional deviation amount calculation unit 90 calculates the amount of positional deviation ΔY based on the peak position $X_{P1}$, the peak position $X_{P2}$, the resolution $R_m$ of the image scanner 16, and the resolution $R_h$ after resolution enhancement using Expressions (5) and (6) described below (Step S54). That is, the amount of positional deviation ΔY is calculated based on the difference between the peak position $X_{P1}$ corresponding to the first dot pattern 94A and the peak position $X_{P2}$ corresponding to the second dot pattern 94B. The positional deviation amount calculation unit 90 outputs the calculation result of the amount of positional deviation ΔY to the positional deviation correction processing unit 45. The amount of positional deviation ΔY is the amount of positional deviation of the recording position including the amount of deviation from a design position shown in FIG. 18, the amount of deviation due to zigzag arrangement, and an error of the ink ejection timing set in each head module at the time of recording of the test chart.

$$(X_{P1}-X_{P2})\div R_h\times R_m\rightarrow p(\text{pixl/scanner resolution}) \quad (5)$$

$$p\div R_m\times 25400\rightarrow \Delta Y \quad (6)$$

Operation of Ink Jet Printer of Third Embodiment

Next, the operation of the printer 80 having the above-described configuration, in particular, measurement processing of the amount of positional deviation ΔY will be described. Image recording processing including positional deviation correction processing is the same as that in the first embodiment, and thus, description thereof will not be repeated. Here, a case of measuring the amount of positional deviation ΔY of the recording position between the first and second head modules 73A and 73B will be described.

Figure 26:
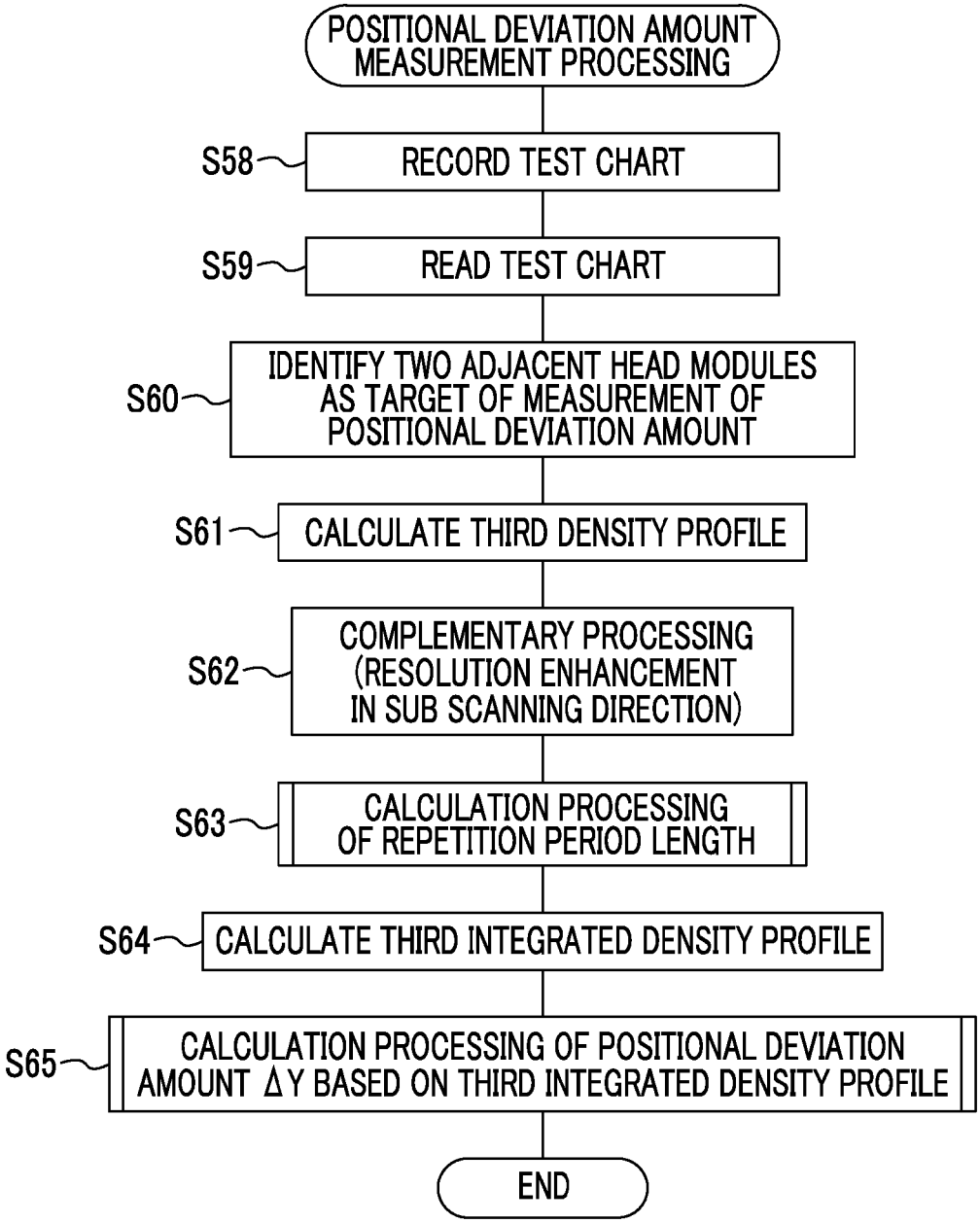
FIG. 26 is a flowchart showing the flow of positional deviation amount measurement processing of the third embodiment.

As shown in FIG. 26, when the printer 80 is powered on, when at least one of the first and second head modules 73A and 73B is newly mounted in the recording head 72, or the like, the respective units 85 to 90 of the CPU 83 are operated to start the measurement processing of the amount of positional deviation ΔY (Step S20).

As in the first embodiment, print data for single deposition based on test chart data 35 is successively transferred to the head driver 23 under the control of the test chart recording control unit 85. The head driver 23 controls ink ejection of the nozzles 27*a* of the head modules 73A to 73C based on print data. Then, the ink droplets 36 are deposited by the head modules 73A to 73C while transporting the recording sheet 13 in the sub scanning direction by the transport mechanism 12, whereby the test chart 81 is recorded in the overlap recording area OLA (Step S58, recording step).

After the recording of the test chart 81, as in the first embodiment, the test chart 81 is read by the image scanner 16, and read image data 32 is output from the image scanner 16 to the density profile data calculation unit 86 (Step S59, reading step).

After the input of read image data 32, the density profile data calculation unit 86 identifies two head modules as a target of measurement of the amount of positional deviation ΔY, that is, the first and second head modules 73A and 73B (Step S60).

Next, the density profile data calculation unit 86 analyzes read image data 32 to calculate the third density profile 96 shown in FIG. 22B (Step S61, density profile calculation step). The third density profile 96 is output from the density profile data calculation unit 86 to the complementary processing unit 87.

The complementary processing unit 87 performs linear complementary processing for the third density profile 96 to generate a resolution-enhanced third density profile 96*a* shown in FIG. 22C (Step S62, complementary processing step). The third density profile 96*a* is output from the complementary processing unit 87 to the repetition period calculation unit 88.

The repetition period calculation unit 88 executes the basically same processing as the processing of Step S1 to Step S9 shown in FIG. 8 to calculate the temporary integrated density profile in each temporary repetition period, and compares the magnitude of the maximum value (the total value of the group 1 and the group 2) of each temporary integrated density profile. With this, the repetition period length W3 shown in FIG. 23A is calculated by the repetition period calculation unit 41 (Step S63, repetition period calculation step). The calculation result of the repetition period length W3 is output from the repetition period calculation unit 88 to the integrated density profile calculation unit 89 along with the third density profile 96*a*.

As shown in FIG. 23B, the integrated density profile calculation unit 89 integrates and averages the third density profile 96*a* in each repetition period length W3 to calculate the third integrated density profile 98 (Step S64, integrated density profile calculation step). The third integrated density profile 98 is output from the integrated density profile calculation unit 89 to the positional deviation amount calculation unit 90.

The positional deviation amount calculation unit 90 executes the processing of Step S50 to Step S54 shown in FIG. 24. With this, as shown in FIGS. 23C and 25, the positional deviation amount calculation unit 90 calculates the amount of positional deviation ΔY of the recording position between the first and second head modules 73A and 73B based on the difference between the peak position $X_{P1}$ and the peak position $X_{P2}$ (Step S65). With the above, the positional deviation amount measurement processing is completed.

Functional Effects of Ink Jet Printer of Third Embodiment

In this way, in the third embodiment of the invention, the test chart 81 recorded in the overlap recording area OLA is analyzed, whereby it is possible to directly calculate the amount of positional deviation ΔY without calculating the reference amounts of positional deviation Δy1 and Δy2 of the head modules as in the first embodiment. With this, it is possible to reduce the time necessary for calculating the amount of positional deviation ΔY. As in the first embodiment, it is possible to measure the amount of positional deviation of the recording position between the head modules at low cost and with high accuracy without using a high-resolution image sensor.

[Configuration Example of Another Ink Jet Printer]

Next, a configuration example of a printer 100 as an example of the printer 10 shown in FIG. 1 will be described.

Figure 27:
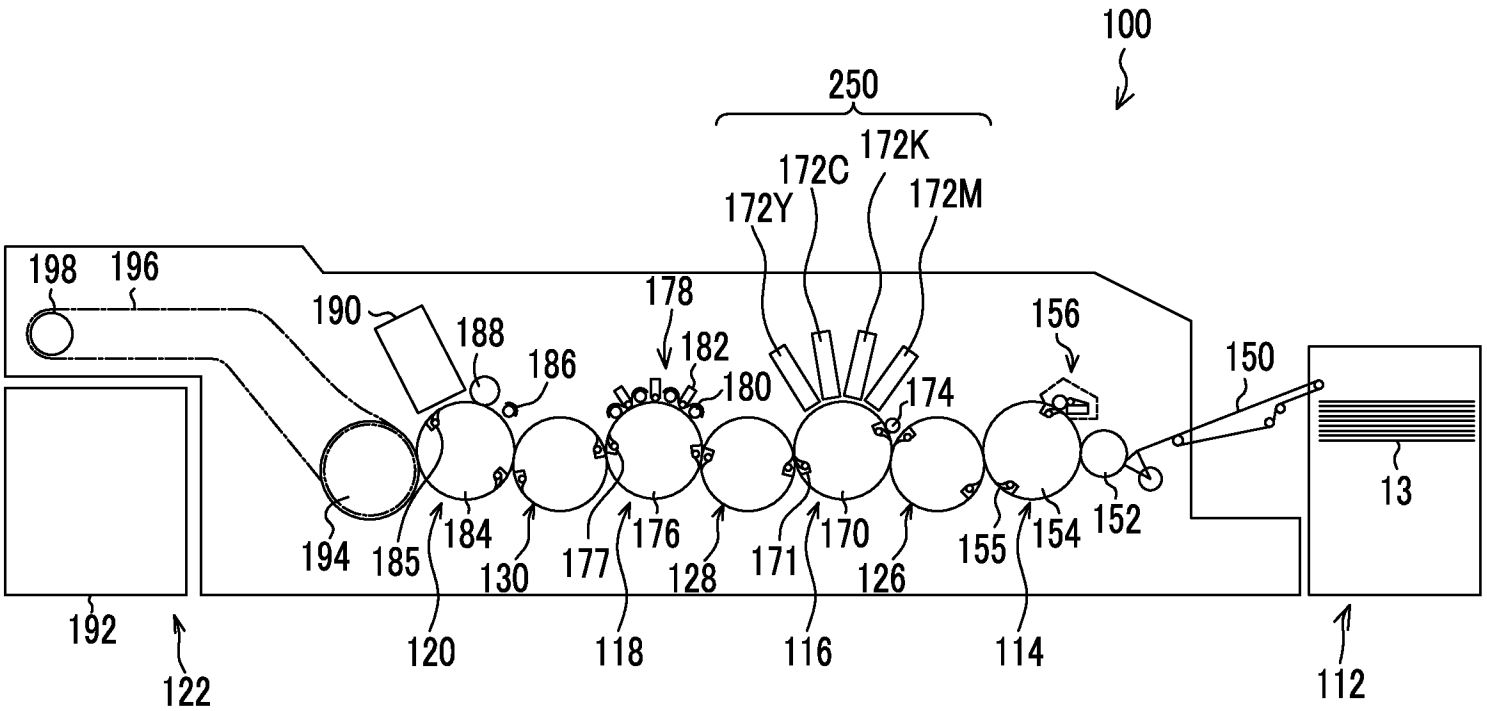
FIG. 27 is a schematic view of an ink jet printer of another example.

As shown in FIG. 27, the printer 100 is a direct drawing ink jet printer which deposits ink of a plurality of colors on a recording sheet 13 retained by a drawing drum 170 from a recording head 250 (constituted by ink jet heads 172M, 172K, 172C, and 172Y of CMYK) to form a desired color image. The printer 100 applies a two-liquid reaction (aggregation) system in which a processing liquid (in this case, an aggregation processing liquid) is applied on the recording sheet 13 before ink deposition, and the processing liquid reacts with the ink liquid to perform image formation on the recording sheet 13.

The printer 100 primarily includes a sheet feed unit 112, a processing liquid application unit 114, a recording unit 116, a drying unit 118, a fixing unit 120, and a sheet discharge unit 122.

(Sheet Feed Unit)

In the sheet feed unit 112, recording sheets 13 which are paper sheets are stacked. The recording sheets 13 are fed from a sheet feed tray 150 of the sheet feed unit 112 to the processing liquid application unit 114 one by one. Although paper sheets (cut paper) are used as the recording sheets 13, a continuous sheet (roll paper) may be cut to a necessary size and fed.

(Processing Liquid Application Unit)

The processing liquid application unit 114 is a mechanism which applies a processing liquid on the surface of the recording sheet 13. The processing liquid includes a coloring material aggregating agent which aggregates a coloring material (in this example, a pigment) in ink applied by the recording unit 116, and the processing liquid comes into contact with ink, thereby promoting separation of the coloring material and the solvent in ink.

The processing liquid application unit 114 includes a sheet feed cylinder 152, a processing liquid drum 154, and a processing liquid coating device 156. The processing liquid drum 154 includes a claw-shaped retaining unit (gripper) 155 on the outer peripheral surface, and the recording sheet 13 is sandwiched between the claw of the retaining unit 155 and the peripheral surface of the processing liquid drum 154 such that the leading end of the recording sheet 13 can be retained. A suction hole may be provided in the outer peripheral surface of the processing liquid drum 154, and a suction unit performing suction from the suction hole may be connected. With this, the recording sheet 13 can be retained tightly on the peripheral surface of the processing liquid drum 154.

The processing liquid coating device 156 is arranged to face the peripheral surface of the processing liquid drum 154. The processing liquid coating device 156 is constituted by a processing liquid container which stores the processing liquid, an annex roller which is partially immersed into the processing liquid of the processing liquid container, and a rubber roller which is brought into press contact with the annex roller and the recording sheet 13 on the processing liquid drum 154 to transfer the processing liquid after measurement to the recording sheet 13. According to the processing liquid coating device 156, it is possible to coat the surface of the recording sheet 13 with the processing liquid while measuring the processing liquid. In this embodiment, although a configuration in which a coating system using a roller is applied has been illustrated, the invention is not limited thereto, and for example, various systems, such as a spray system and an ink jet system, may be applied.

The recording sheet 13 applied with the processing liquid is delivered from the processing liquid drum 154 to a drawing drum 170 of the recording unit 116 through an intermediate transport unit 126.

(Recording Unit)

The recording unit 116 includes a drawing drum 170, a sheet pressing roller 174, and an ink jet head 250 (ink jet heads 172M, 172K, 172C, and 172Y). Similarly to the processing liquid drum 154, the drawing drum 170 includes claw-shaped retaining unit (gripper) 171 on the outer peripheral surface.

Each of the ink jet heads 172M, 172K, 172C, and 172Y is a full line ink jet system ink jet head which has a length corresponding to the maximum width of an image forming area in the recording sheet 13, and a nozzle array having a plurality of nozzles for ink ejection over the full width of the image forming area is formed on the ink ejection surface. The ink jet heads 172M, 172K, 172C, and 172Y are arranged so as to extend in a direction (first direction) orthogonal to the transport direction (the rotation direction of the drawing drum 170, second direction) of the recording sheet 13.

The droplets of corresponding color ink are ejected from the ink jet heads 172M, 172K, 172C, and 172Y of the ink jet head 250 arranged to face the surface of the recording sheet 13 toward the surface of the recording sheet 13 retained tightly on the drawing drum 170, ink comes into contact with the processing liquid applied to the recording surface applied in advance by the processing liquid application unit 114, the coloring materials (pigments) dispersed in ink are aggregated, and a coloring material aggregate is formed. With this, coloring material bleeding on the recording sheet 13 is prevented, and an image is formed on the surface of the recording sheet 13.

That is, the recording sheet 13 is transported by the drawing drum 170 at a given speed and an operation of relatively moving the recording sheet 13 and the ink jet heads 172M, 172K, 172C, and 172Y with respect to the transport direction is performed only once (that is, single sub scanning is performed), whereby an image can be recorded in the image forming area on the surface of the recording sheet 13.

The recording sheet 13 with the image formed thereon is delivered from the drawing drum 170 to a drying drum 176 of the drying unit 118 through an intermediate transport unit 128.

(Drying Unit)

The drying unit 118 is a mechanism which dries moisture contained in the solvent separated by the coloring material aggregation, and includes a drying drum 176 and a solvent drying device 178. Similarly to the processing liquid drum 154, the drying drum 176 includes a claw-shaped retaining unit (gripper) 177 on the outer peripheral surface, and the leading end of the recording sheet 13 can be retained by the retaining unit 177.

The solvent drying device 178 is arranged at a position facing the outer peripheral surface of the drying drum 176, and is constituted by a plurality of halogen heaters 180, and hot air injection nozzles 182 arranged between the halogen heaters 180. The recording sheet 13 subjected to drying processing in the drying unit 118 is delivered from the drying drum 176 to a fixing drum 184 of the fixing unit 120 through an intermediate transport unit 130.

(Fixing Unit)

The fixing unit 120 is constituted by a fixing drum 184, halogen heaters 186, a fixing roller 188, and an inline sensor 190. Similarly to the processing liquid drum 154, the fixing drum 184 includes a claw-shaped retaining unit (gripper) 185 on the outer peripheral surface, and the leading end of the recording sheet 13 can be retained by the retaining unit 185.

With the rotation of the fixing drum 184, preheating by the halogen heaters 186, fixing processing by the fixing roller 188, and examination by the inline sensor 190 are performed for the recording surface (both surfaces) of the recording sheet 13.

The fixing roller 188 is a roller member which heats and presses dried ink to weld self-dispersive polymer particulates in ink and forms a film of ink, and is configured to heat and press the recording sheet 13. Specifically, the fixing roller 188 is arranged so as to come into press contact with the fixing drum 184, and constitutes a nip roller with the fixing drum 184. The recording sheet 13 is sandwiched between the fixing roller 188 and the fixing drum 184 and is nipped at a predetermined nip pressure, and fixing processing is performed.

The fixing roller 188 is constituted by a heating roller in which a halogen lamp or the like is incorporated, and is controlled at a predetermined temperature.

The inline sensor (reading unit) 190 is a unit for reading an image formed on the recording sheet 13 and detecting image density, image defect, or the like, and a CCD line sensor or the like is applied. The inline sensor 190 is basically the same as the image scanner 16 described above.

According to the fixing unit 120, since latex particles in a thin image layer formed by the drying unit 118 are heated and pressed by the fixing roller 188 and melted, ink can be fixed on the recording sheet 13. The surface temperature of the fixing drum 184 is set to be equal or higher 50° C.

Instead of ink containing a high boiling point solvent and polymer particulates (thermoplastic resin particles), ink which contains a monomer component capable of being polymerization-curable with UV exposure may be used. In this case, the printer 100 includes a UV exposure unit which exposes UV light to ink on the recording sheet 13, instead of a hot pressing fixing unit (fixing roller 188) using a heating roller. In this case, when ink containing active ray-curable resin, such as UV-curing resin, is used, instead of the fixing roller 188 for heating and fixing, a unit irradiating active rays, such as a UV lamp or an ultraviolet laser diode (LD) array, is provided.

(Sheet Discharge Unit)

The sheet discharge unit 122 is provided after the fixing unit 120. The sheet discharge unit 122 includes a discharge tray 192, and a transfer cylinder 194, a transport belt 196, and a tension roller 198 are provided between the discharge tray 192 and the fixing drum 184 of the fixing unit 120. The recording sheet 13 is transferred to the transport belt 196 by the transfer cylinder 194 and is discharged to the discharge tray 192. Though details of a sheet transport mechanism using the transport belt 196 are not shown, the recording sheet 13 after printing is carried above the discharge tray 192 by the rotation of the transport belt 196 in a state where the leading end of the sheet is retained by a gripper of a bar (not shown) across the endless transport belt 196.

Though not shown, the printer 100 of this example includes, in addition to the above-described configuration, an ink storage/loading unit which supplies ink to the ink jet heads 172M, 172K, 172C, and 172Y, a unit supplying a processing liquid to the processing liquid application unit 114, a head maintenance unit which performs cleaning (wiping of the nozzle surface, purging, nozzle suction, and the like) of the ink jet heads 172M, 172K, 172C, and 172Y, a position detection sensor which detects the position of the recording sheet 13 on a sheet transport path, a temperature sensor which detects the temperature of each unit of the device, and the like.

[Structure of Ink Jet Head]

Next, the structure of each of the ink jet heads 172M, 172K, 172C, and 172Y in the recording unit 116 will be described. Since the ink jet heads 172M, 172K, 172C, and 172Y corresponding to the respective colors have the common structure, hereinafter, these ink jet heads will be representatively described as the ink jet head 250.

Figure 28:
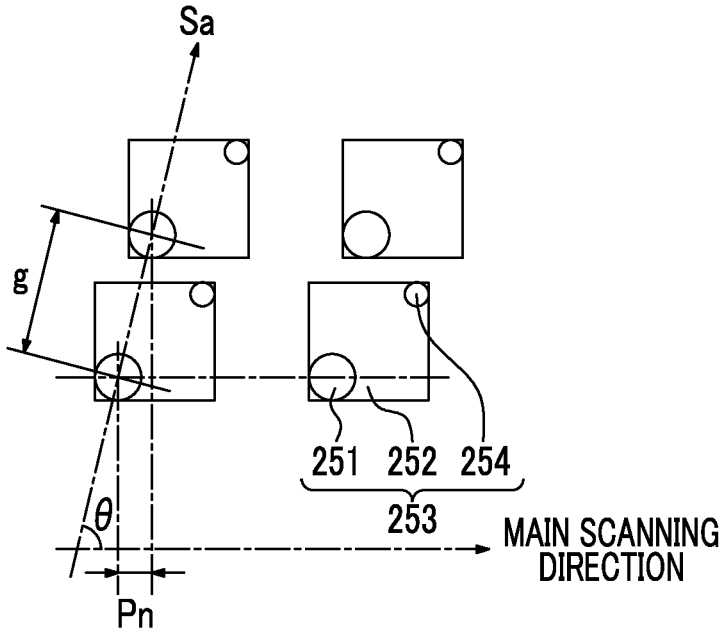
FIG. 28 is a schematic view showing a structure example of an ink jet head.

As shown in FIG. 28, the ink jet head 250 has a structure in which a plurality of ink chamber units (liquid droplet ejection elements as a recording element unit) 253 having a nozzle 251 as an ink ejection port, a pressure chamber 252 communicating with the nozzle 251, and a supply port 254 communicating a common flow channel (not shown) with the pressure chamber 252, and the like are arranged in a matrix. With this, the ink jet head 250 attains the high density of a substantial nozzle interval (a projection nozzle pitch represented by reference numeral Pn) which is projected so as to align in the main scanning direction as the longitudinal direction of the ink jet head 250.

The pressure chamber 252 communicating with the nozzle 251 schematically has a square planar shape, the nozzle 251 is provided at one of both corners on the diagonal, and the supply port 254 is provided at the other corner. The shape of the pressure chamber 252 is not limited to this example, and may have various planar shapes, such as a quadrangle (rhomboid, rectangle, or the like), a pentagon, a hexagon, other polygons, a circle, and an ellipse.

The ink chamber units 253 having the nozzle 251, the pressure chamber 252, and the like are arranged in a matrix in a given arrangement pattern in a row direction along the main scanning direction and an oblique column direction (represented by reference numeral Sa) not orthogonal to the main scanning direction at a given angle θ ($0°<\theta<90°$), whereby the high-density nozzle head of this example is implemented.

With the structure in which a plurality of ink chamber units 253 are arranged at given pitches g in a direction at a certain angle θ with respect to the main scanning direction, the projection nozzle pitch Pn projected so as to align in the main scanning direction becomes $g \times \cos\theta$. For this reason, the main scanning direction can be handled equivalent to the nozzles 251 linearly arranged at given pitches Pn. With this configuration, a nozzle array projected so as to align in the main scanning direction can implement high-density arrangement of 1200 per inch (1200 nozzles/inch).

Figure 29:
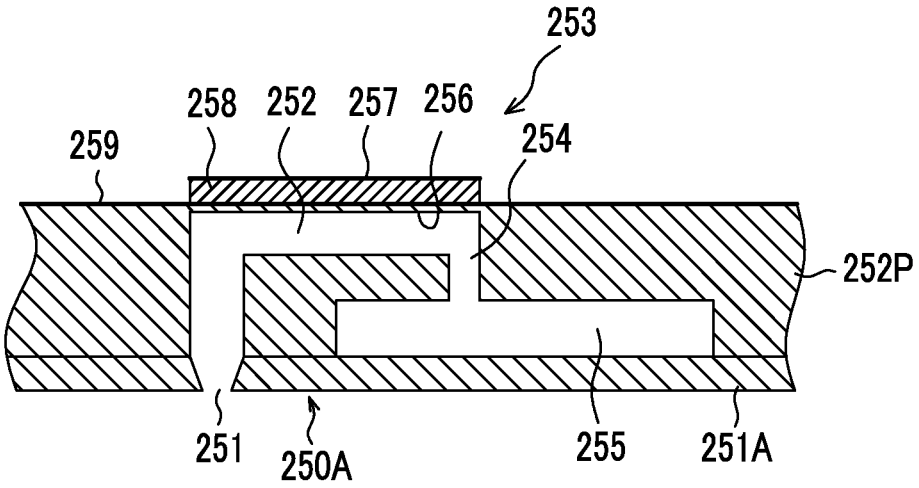
FIG. 29 is a schematic view of an ink jet head.

As shown in FIG. 29, the ink jet head 250 has a structure in which a nozzle plate 251A in which the nozzle 251 is formed and a flow channel plate 252P in which the pressure chamber 252 and a flow channel, such as the common flow channel 255, are formed are laminated and bonded together.

The flow channel plate 252P is a flow channel forming member which constitutes the sidewall portion of the pressure chamber 252 and forms a supply port 254 as a throttle portion (narrowest portion) of an individual supply path guiding ink from the common flow channel 255 to the pressure chamber 252. Though schematically shown in FIG. 29 for convenience of description, the flow channel plate 252P has a structure in which one substrate is provided or a plurality of substrates are laminated.

The nozzle plate 251A and the flow channel plate 252P can be machined to a required shape by a semiconductor manufacturing process using silicon as a material.

The common flow channel 255 communicates with an ink tank (not shown) as an ink supply source, and ink supplied from the ink tank is supplied to each pressure chamber 252 through the common flow channel 255.

A piezoelectric actuator 258 including an individual electrode 257 is bonded to a vibration plate 256 constituting the surface (in FIG. 29, a top surface) of a part of the pressure chamber 252. The vibration plate 256 of this example is made of silicon (Si) with a nickel (Ni) conductive layer which functions as a common electrode 259 corresponding to a lower electrode of the piezoelectric actuator 258, and is also used as a common electrode of the piezoelectric actuator 258 arranged corresponding to each pressure chamber 252. An aspect in which a vibration plate is formed of a nonconductive material, such as resin, may be made, and in this case, a common electrode layer made of a conductive material, such as metal, is formed on the surface of a vibration plate member. A vibration plate which is also used as a common electrode may be made of a metal (conductive material), such as stainless steel (SUS).

With the application of a drive voltage to the individual electrode 257, the piezoelectric actuator 258 is deformed to change the volume of the pressure chamber 252, and ink is ejected from the nozzle 251 with accompanying change in pressure. After ink ejection, when the piezoelectric actuator 258 returns to the original state, new ink refills the pressure chamber 252 from the common flow channel 255 through the supply port 254.

In this example, although the printer 100 to which an impression cylinder transport system is applied has been illustrated, a transport system of the recording sheet 13 is not limited to the impression cylinder transport system, and a belt transport system in which the recording sheet 13 is transported in a state adsorbed and retained on a transport belt, or other transport systems can be appropriately selected.

An arrangement form of the nozzles 251 is not limited to the example shown in the drawing, and various nozzle arrangement structures can be applied. For example, polygonal nozzle arrangement, such as single-line linear arrangement, V-shaped nozzle arrangement, or zigzag arrangement (W-shaped arrangement) with V-shaped arrangement as a repetition unit, can be used.

Others

In the respective embodiments described above, although the amount of positional deviation ΔY of the recording position between adjacent head modules is calculated, the amount of positional deviation ΔY of the recording position between arbitrary head modules not adjacent to each other can be calculated using the same method. When the interval in the main scanning direction between the head modules as a target of measurement of the amount of positional deviation is wider, the tilt (rotation displacement of the recording head 72 with a direction perpendicular to the surface of the recording sheet 13) of the recording head 72, an error of the transport speed of the recording sheet 13, deformation of the recording sheet 13, an error of reading of the image scanner 16, or the like affects the measurement result of the amount of positional deviation. For this reason, adjacent head modules are selected as a target of measurement of the amount of positional deviation ΔY, whereby it is possible to measure the amount of positional deviation ΔY with higher accuracy.

In the respective embodiments described above, although the linear complementary processing is performed for each density profile by the complementary processing unit 40 or 87, a complementary method is not particularly limited as long as the resolution of each density profile can be enhanced in the sub scanning direction. A calculation method of the repetition period length W2 or W3 of each density profile is not particularly limited to the method shown in FIGS. 8 and 9 described above, and various known methods may be used.

In the respective embodiments described above, although the pattern interval W1 (period length) is arbitrarily set, it is preferable that the pattern interval W1 is a non-integer multiple of resolution of the image sensor of the image scanner 16 in the sub scanning direction. With this, since the reading position of the image sensor for each dot pattern arranged in the sub scanning direction is gradually deviated, for example, data at various measurement points in the sub scanning direction in the first density profile 53A of FIG. 6B is obtained. As a result, since a more accurate waveform of the first integrated density profile 56A shown in FIG. 7B is obtained, it is possible to accurately determine the peak position.

In the respective embodiments described above, although the first to third density profiles 53A, 53B, and 96 are integrated and averaged in each repetition period length W2 or W3 to calculate the first to third integrated density profiles 56A, 56B, and 98, the density profiles 53A, 53B, and 96 may be integrated in each repetition period length W2 or W3 to calculate the first to third integrated density profiles without performing average processing.

In the respective embodiments described above, although 150 dot patterns are formed in the sub scanning direction, the number of dot patterns may be appropriately increased or decreased. When the number of dot patterns is great, the number of pieces of data of each density profile increases; thus, it is possible to measure the amount of positional deviation ΔY with higher accuracy.

Although the recording head of the embodiments described above perform recording of four colors of CMYK, colors to be recorded are not particularly limited. Furthermore, the invention can be applied to an ink jet printer which includes, for example, a shuttle head type recording head, in which a recording head is moved with respect to a recording sheet, instead of moving a recording sheet with respect to a fixed recording head.

In the respective embodiments described above, although an example where the invention is applied to an ink jet printer for graphic printing has been described, the application range of the invention is not limited to this example. For example, the invention can be widely applied to ink jet printers which draw various shapes or patterns using liquid functional materials, such as a wiring drawing device which draws wiring patterns of electronic circuits, manufacturing devices of various devices, a resist printing device which uses a resin liquid as a function liquid for ejection, a color filter manufacturing device, and a microstructure forming device which forms microstructures using a material for material deposition.

In the respective embodiments described above, although an example where an ink jet printer is provided as an image-recording device of the invention has been described, the invention can be applied to various image-recording devices, such as a thermal transfer recording device which has a plurality of recording heads each having thermal elements as recording elements, and an LED electrophotographic printer which has a plurality of recording heads having LED elements as recording elements.

What is claimed is:

1. A method for measuring an amount of positional deviation between recording positions of a plurality of head modules, the method comprising:

a recording step of, while relatively moving a recording head with a plurality of head modules each having a plurality of recording elements arranged in a first direction and a recording medium in a second direction orthogonal to the first direction, recording dot patterns having a shape extended in the first direction on the recording medium at intervals determined in advance in the second direction using a first head module and a second head module among the plurality of head modules;

a reading step of optically reading the dot patterns recorded on the recording medium in the recording step;

a density profile calculation step of calculating a density profile associated with the first head module representing change in density in the second direction of a read image of the dot patterns read in the reading step;

a repetition period calculation step of calculating a repetition period of a waveform corresponding to each dot pattern in the density profile based on a calculation result in the density profile calculation step;

an integrated density profile calculation step of integrating data of the density profile based on a calculation result of the repetition period calculation step in each repetition period to calculate an integrated density profile associated with the first head module; and a positional deviation amount calculation step of obtaining a peak position of a waveform corresponding to each dot pattern in the integrated density profile based on a calculation result of the integrated density profile calculation step and calculating the amount of positional deviation in the second direction between a recording position of the first head module and a recording position of the second head module based on the peak position and another peak position associated with the second head module.

2. The method for measuring the amount of positional deviation according to claim 1, wherein, in the density profile calculation step, a first density profile corresponding to a first dot pattern recorded by the first head module and a second density profile corresponding to a second dot pattern recorded by the second head module are calculated as the density profile, in the repetition period calculation step, a first repetition period of a waveform corresponding to the first dot pattern and a second repetition period representing a repetition period of a waveform corresponding to the second dot pattern are calculated as the repetition period based on the first and second density profiles, in the integrated density profile calculation step, a first integrated density profile obtained by integrating data of the first density profile in each first repetition period and second integrated density profile obtained by integrating data of the second density profile in each second repetition period are calculated as the integrated density profile, and in the positional deviation amount calculation step, a first peak position of a waveform corresponding to the first dot pattern in the first integrated density profile and a second peak position of a waveform corresponding to the second dot pattern in the second integrated density profile are obtained, and the amount of positional deviation is calculated based on the difference between the first peak position and the second peak position.

3. The method for measuring the amount of positional deviation according to claim 2, wherein the first head module and the second head module are connected to each other in the first direction.

4. The method for measuring the amount of positional deviation according to claim 3, wherein, in an overlap recording area where recording areas on the recording medium of the first and second head modules partially overlap each other, in the recording step, the first dot pattern and the second dot pattern are recorded by the recording elements of the first and second head modules which perform recording in a recording area other than the overlap area.

5. The method for measuring the amount of positional deviation according to claim 4, wherein the repetition period calculation step has a temporary integrated density profile calculation step of integrating data of the density profile in each temporary repetition period to calculate a temporary integrated density profile, a repetition step of, while changing the temporary repetition period, repeatedly executing the temporary integrated density profile calculation step to calculate the temporary integrated density profile in each temporary repetition period, and a determination step of comparing a maximum value of the temporary integrated density profile in each temporary repetition period and determining the temporary repetition period with the greatest maximum value as the repetition period.

6. The method for measuring the amount of positional deviation according to claim 3, wherein the repetition period calculation step has a temporary integrated density profile calculation step of integrating data of the density profile in each temporary repetition period to calculate a temporary integrated density profile, a repetition step of, while changing the temporary repetition period, repeatedly executing the temporary integrated density profile calculation step to calculate the temporary integrated density profile in each temporary repetition period, and a determination step of comparing a maximum value of the temporary integrated density profile in each temporary repetition period and determining the temporary repetition period with the greatest maximum value as the repetition period.

7. The method for measuring the amount of positional deviation according to claim 3, further comprising:

a complementary processing step of performing complementary processing on a density profile calculated in the density profile calculation step to enhance resolution of the density profile in the second direction, wherein, in the repetition period calculation step, a repetition period is calculated based on a density profile subjected to the complementary processing.

8. The method for measuring the amount of positional deviation according to claim 2, wherein the repetition period calculation step has a temporary integrated density profile calculation step of integrating data of the density profile in each temporary repetition period to calculate a temporary integrated density profile, a repetition step of, while changing the temporary repetition period, repeatedly executing the temporary integrated density profile calculation step to calculate the temporary integrated density profile in each temporary repetition period, and a determination step of comparing a maximum value of the temporary integrated density profile in each temporary repetition period and determining the temporary repetition period with the greatest maximum value as the repetition period.

9. The method for measuring the amount of positional deviation according to claim 2, further comprising:

a complementary processing step of performing complementary processing on a density profile calculated in the density profile calculation step to enhance resolution of the density profile in the second direction, wherein, in the repetition period calculation step, a repetition period is calculated based on a density profile subjected to the complementary processing.

10. The method for measuring the amount of positional deviation according to claim 2, wherein the first direction is a width direction of the recording medium.

11. The method for measuring the amount of positional deviation according to claim 1, wherein, in an overlap recording area where recording areas on the recording medium of the first and second head modules partially overlap each other, in the recording step, a first dot pattern and a second dot pattern are individually recorded alternately at intervals determined in advance in the second direction as the dot patterns using the recording elements of the first and second head modules which perform recording in the overlap recording area, in the density profile calculation step, a third density profile corresponding to the first dot pattern and the second dot pattern is calculated as the density profile, in the repetition period calculation step, a third repetition period representing a repetition period of a waveform corresponding to the first and second dot patterns in the third density profile is calculated, in the integrated density profile calculation step, a third integrated density profile obtained by integrating data of the third density profile in each third repetition period is calculated as the integrated density profile, and in the positional deviation amount calculation step, a first peak position of a waveform corresponding to the first dot pattern and a second peak position of a waveform corresponding to the second dot pattern in the third integrated density profile are obtained, and the amount of positional deviation is calculated based on the difference between the first peak position and the second peak position.

12. The method for measuring the amount of positional deviation according to claim 11, wherein the repetition period calculation step has a temporary integrated density profile calculation step of integrating data of the density profile in each temporary repetition period to calculate a temporary integrated density profile, a repetition step of, while changing the temporary repetition period, repeatedly executing the temporary integrated density profile calculation step to calculate the temporary integrated density profile in each temporary repetition period, and a determination step of comparing a maximum value of the temporary integrated density profile in each temporary repetition period and determining the temporary repetition period with the greatest maximum value as the repetition period.

13. The method for measuring the amount of positional deviation according to claim 11, further comprising:

a complementary processing step of performing complementary processing on a density profile calculated in the density profile calculation step to enhance resolution of the density profile in the second direction, wherein, in the repetition period calculation step, a repetition period is calculated based on a density profile subjected to the complementary processing.

14. The method for measuring the amount of positional deviation according to claim 1, wherein the repetition period calculation step has a temporary integrated density profile calculation step of integrating data of the density profile in each temporary repetition period to calculate a temporary integrated density profile, a repetition step of, while changing the temporary repetition period, repeatedly executing the temporary integrated density profile calculation step to calculate the temporary integrated density profile in each temporary repetition period, and a determination step of comparing a maximum value of the temporary integrated density profile in each temporary repetition period and determining the temporary repetition period with the greatest maximum value as the repetition period.

15. The method for measuring the amount of positional deviation according to claim 1, further comprising:

a complementary processing step of performing complementary processing on a density profile calculated in the density profile calculation step to enhance resolution of the density profile in the second direction, wherein, in the repetition period calculation step, a repetition period is calculated based on a density profile subjected to the complementary processing.

16. The method for measuring the amount of positional deviation according to claim 1, wherein the first direction is a width direction of the recording medium.

17. The method for measuring the amount of positional deviation according to claim 1, wherein the recording head is an ink jet head.

18. An image-recording device for using the method for measuring the amount of positional deviation according to claim 1, the image-recording device comprising:

a recording head with a plurality of head modules each having a plurality of recording elements arranged in a first direction;

a relative moving unit which relatively moves the recording head and a recording medium in a second direction orthogonal to the first direction;

a recording control unit which controls the recording head and the relative moving unit such that dot patterns having a shape extended in the first direction are recorded on the recording medium at intervals determined in advance in the second direction using a first head module and a second head module among the plurality of head modules;

a reading unit which optically reads the dot patterns recorded on the recording medium using the first head module and the second head module;

a density profile calculation unit which calculates a density profile representing change in density in the second direction of a read image of the dot patterns read by the reading unit;

a repetition period calculation unit which calculates a repetition period corresponding to each dot pattern in the density profile based on a calculation result of the density profile calculation unit;

an integrated density profile calculation unit which integrates data of the density profile based on a calculation result of the repetition period calculation unit in each repetition period to calculate an integrated density profile; and a positional deviation amount calculation unit which obtains a peak position of a waveform corresponding to each dot pattern in the integrated density profile based on a calculation result of the integrated density profile calculation unit and calculates the amount of positional deviation in the second direction between a recording position of the first head module and a recording position of the second head module based on the peak position.

* * * * *